US006295250B1

(12) United States Patent
Ray et al.

(10) Patent No.: US 6,295,250 B1
(45) Date of Patent: Sep. 25, 2001

(54) TIME-SETTING MECHANISM FOR CLOCK MOVEMENT WITH PERPETUAL JULIAN DATE

(75) Inventors: Claude Ray, Montezillon (CH); Christian Taillard, Les Fins (FR)

(73) Assignee: Girard-Perregaux S.A., La Chaux-de-Fonds (CH)

( * ) Notice: Subject to any disclaimer, the term of this patent is extended or adjusted under 35 U.S.C. 154(b) by 0 days.

(21) Appl. No.: 09/381,717

(22) PCT Filed: Mar. 20, 1998

(86) PCT No.: PCT/CH98/00110

§ 371 Date: Dec. 27, 1999

§ 102(e) Date: Dec. 27, 1999

(87) PCT Pub. No.: WO98/44394

PCT Pub. Date: Oct. 8, 1998

(30) Foreign Application Priority Data

Mar. 27, 1997 (CH) ..... 744 97

(51) Int. Cl.[7] ..... G04B 19/20
(52) U.S. Cl. ..... 368/37; 368/38
(58) Field of Search ..... 368/28, 37–39

(56) References Cited

U.S. PATENT DOCUMENTS 3,716,983 * 2/1973 Tanaka et al. ..... 368/28
4,026,100 * 5/1977 Kume et al. ..... 368/37
6,118,734 * 9/2000 Ray et al. ..... 368/37

* cited by examiner

*Primary Examiner*—Bernard Roskoski
(74) *Attorney, Agent, or Firm*—Baker Botts L.L.P.

(57) ABSTRACT

A time-setting mechanism for a clock movement with perpetual Julian date comprising a device for driving a date indicator including driving means for moving forward said indicator by one jump every twenty-four hours. The movement has an adjusting device for automatically moving said indicator by a number of steps taking into account months with 28, 29 or 30 days, said device comprising a rotary cam driven by at least one step every twenty-four hours, said cam having a profile for steering a sensor bringing about: the oscillating movement of a moving mechanism provided with a pawl system for moving forward the date indicator by the required additional number of adjusting steps; and for moving forward said cam by a number of steps equal to the number of said indicator adjusting steps so as to make it move one complete cycle per year.

8 Claims, 24 Drawing Sheets

TIME-SETTING MECHANISM FOR CLOCK MOVEMENT WITH PERPETUAL JULIAN DATE

This invention concerns a mechanism for setting the hour, date, month and year of a perpetual date calendar movement, which includes at least devices for display of the hour, date, month and year. In particular, the invention concerns such a mechanism that allows rapid correction of the information on the displays mentioned above.

Perpetual date mechanisms of an exclusively mechanical type are generally associated with mechanical movements, and in particular with automatic timepiece movements whose operation stops either when they are not manually wound (simple mechanical movement), or when they are not carried by a user (automatic mechanical movement).

Thus, when watches containing such movements are sold, it is often necessary to correct information about time, that is, setting the hour, date, month and possibly the year, since sales are usually made after stocking the watches in a warehouse for several months after they are received from the factory or the wholesaler.

Currently, this correction activity is complicated and is difficult to understand both for the uninformed user and the seller. This type of difficulty often results in aborting the sale. This correction operation is done by means of the conventional time-setting stem and by a combination of correcting pushing devices, which are active only for a period of the day, each indication of the date having its correcting pushing device (date, months, years).

Thus, the goal of this invention is to remedy this disadvantage by supplying a time-setting mechanism for the date, month and year of a perpetual date movement, whose correction operations may be carried out simply and quickly, essentially by manipulation of the conventional time-setting stem.

To that end, the purpose of this invention is a mechanism for setting time in a perpetual date timepiece movement which includes a driving device for driving a date display including driving means that can advance that indicator by jumps once every 24 hours, this movement also including an adjusting device that allows this indicator to make adjusting steps to automatically take account of months with 28, 29 or 30 days, said device including a rotary cam which is moved at least one step every 24 hours, this cam having a profile suitable for operating a sensor, causing:

- on the one hand, the oscillating movement of a mobile assembly with a pawl system to make the date display of the required additional adjusting step or steps advance, and
- on the other hand, the advancement of this cam to make it carry out a number of steps equal to the number of the adjusting steps of this indicator in order to have it make one complete turn per year, characterized in that it comprises means for disengaging the sensor to disengage it from the profile of that cam, and means for coupling the indicator with that cam, said coupling means being operated by said disengaging means which are themselves controlled by a control stem.

Other characteristics and advantages of the invention will become apparent from the detailed description which follows, with reference to the attached drawings which are given only as examples and in which.

Figure 13:
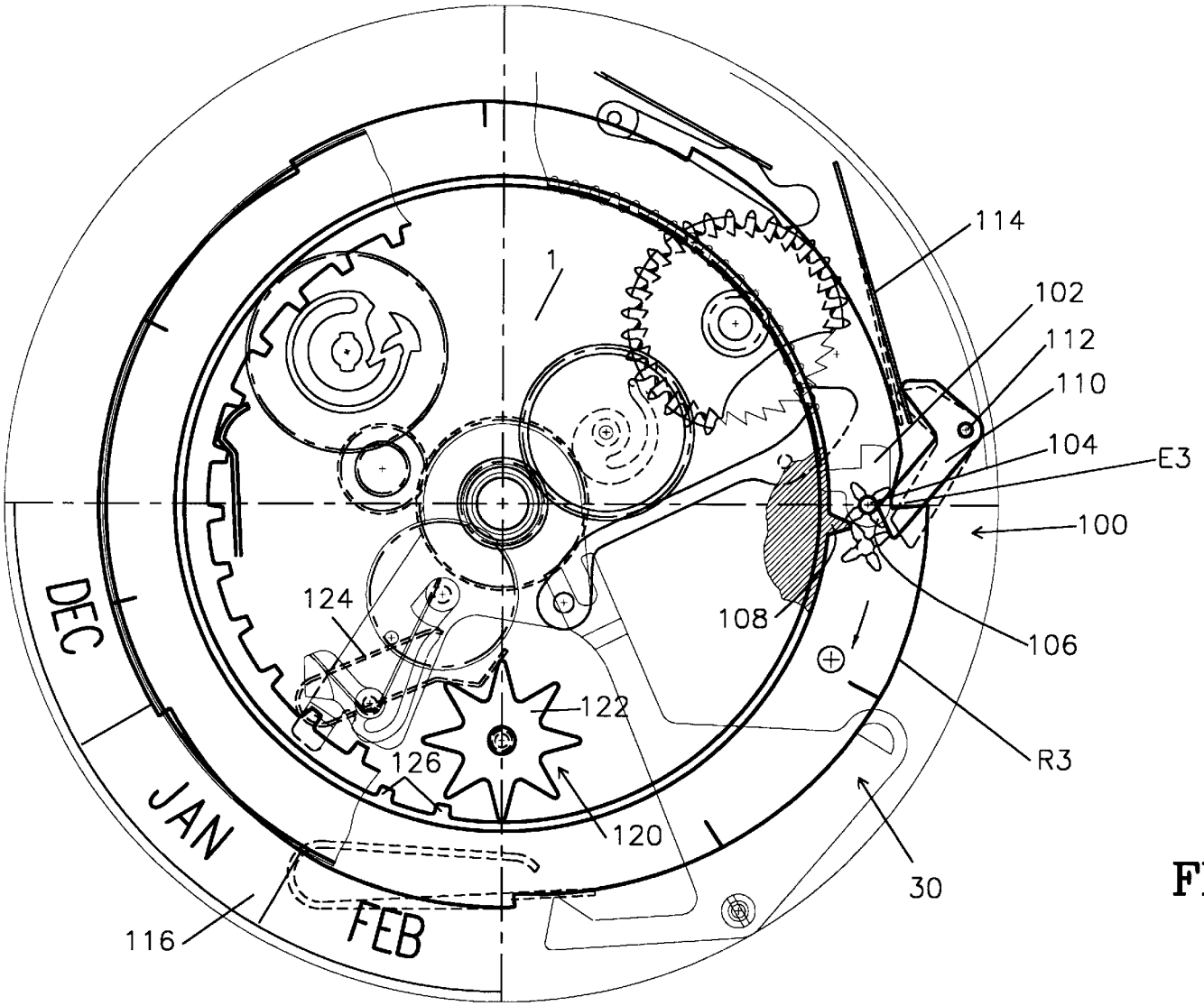
FIG. 13 is also a top view ef the movement according to the invention, on which the mobile flap system is seen, allowing February months of 29 days (leap years) to be taken into account.
Figure 14:
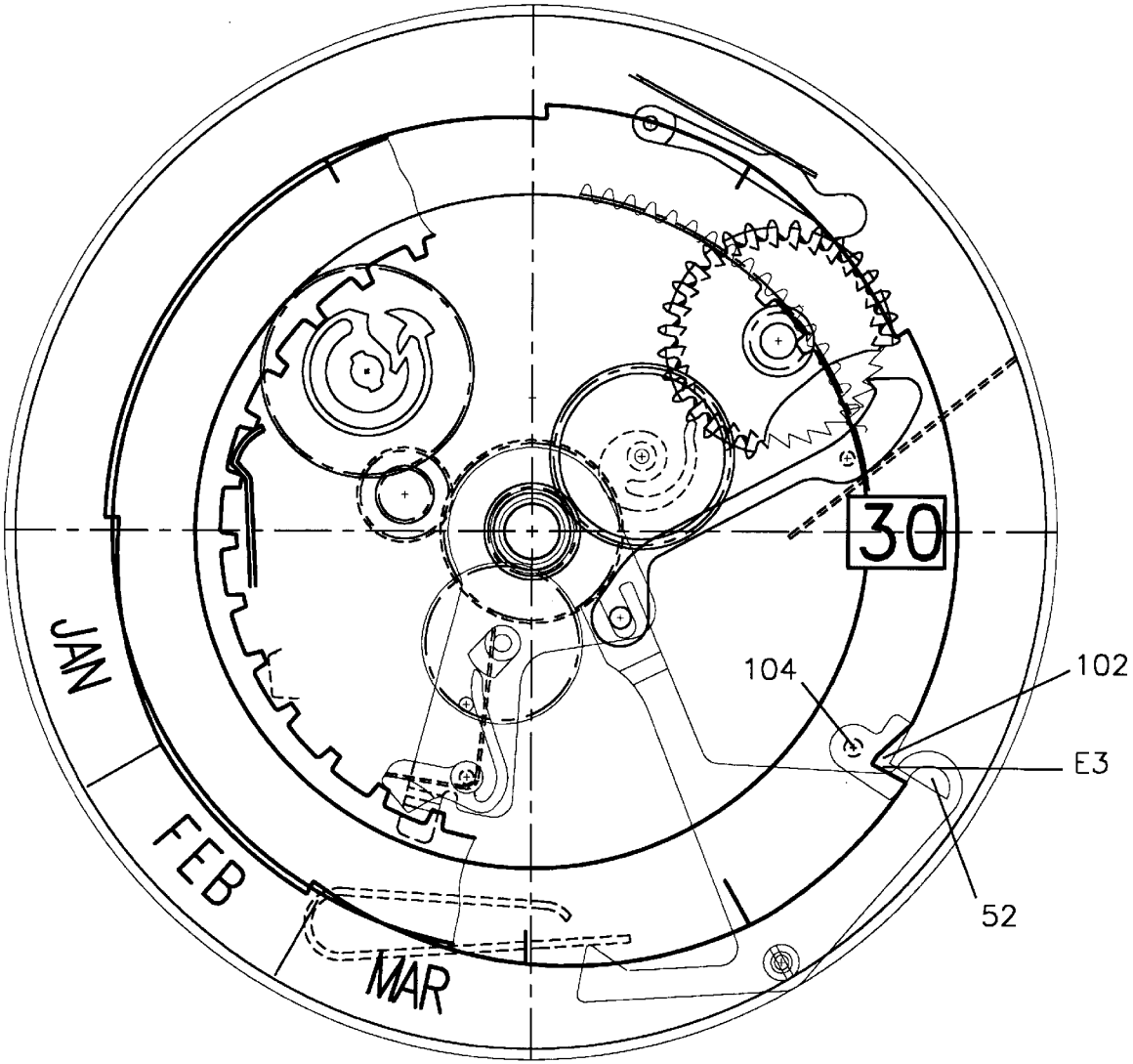
Figure 15:
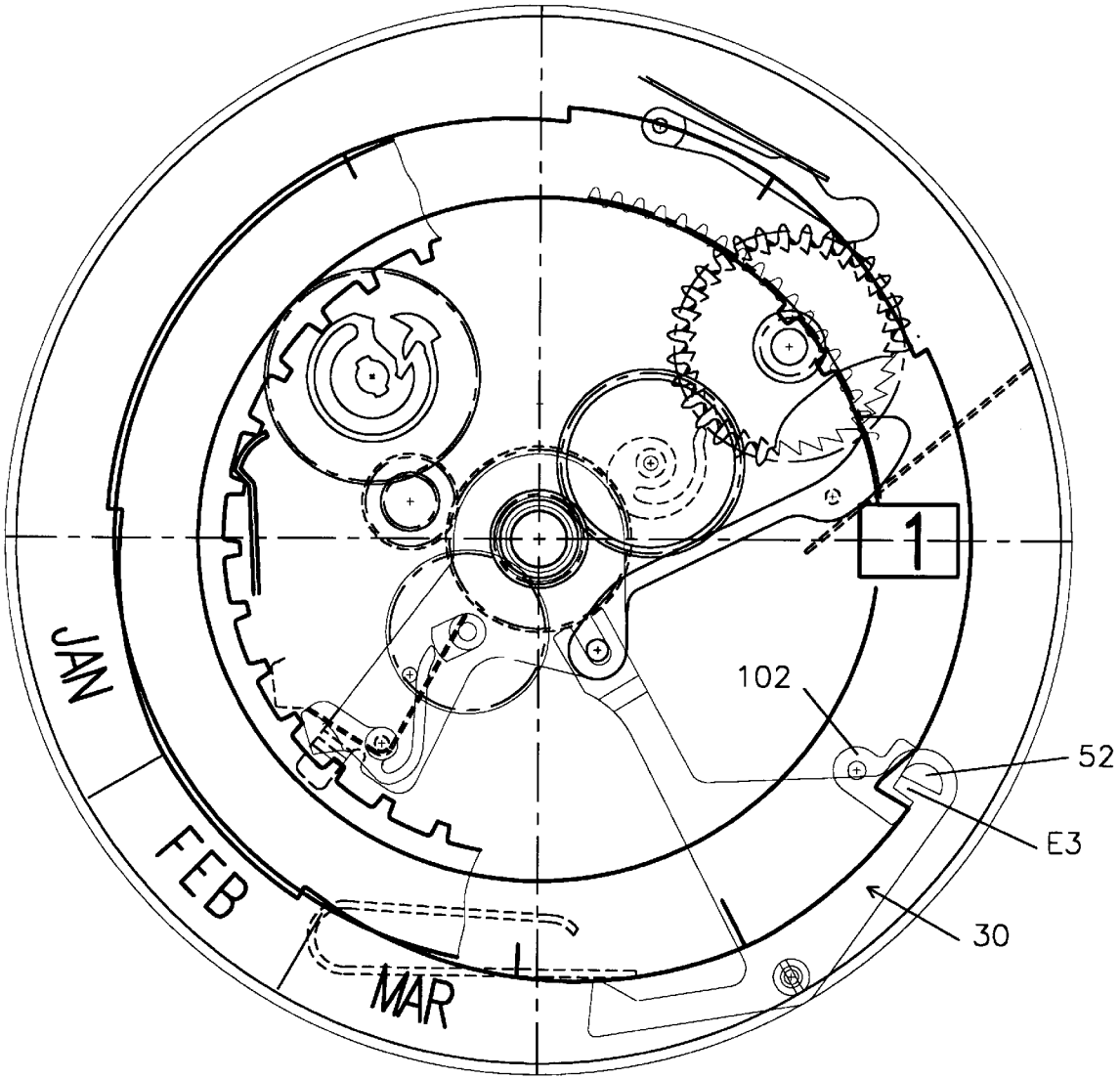
Figure 18:
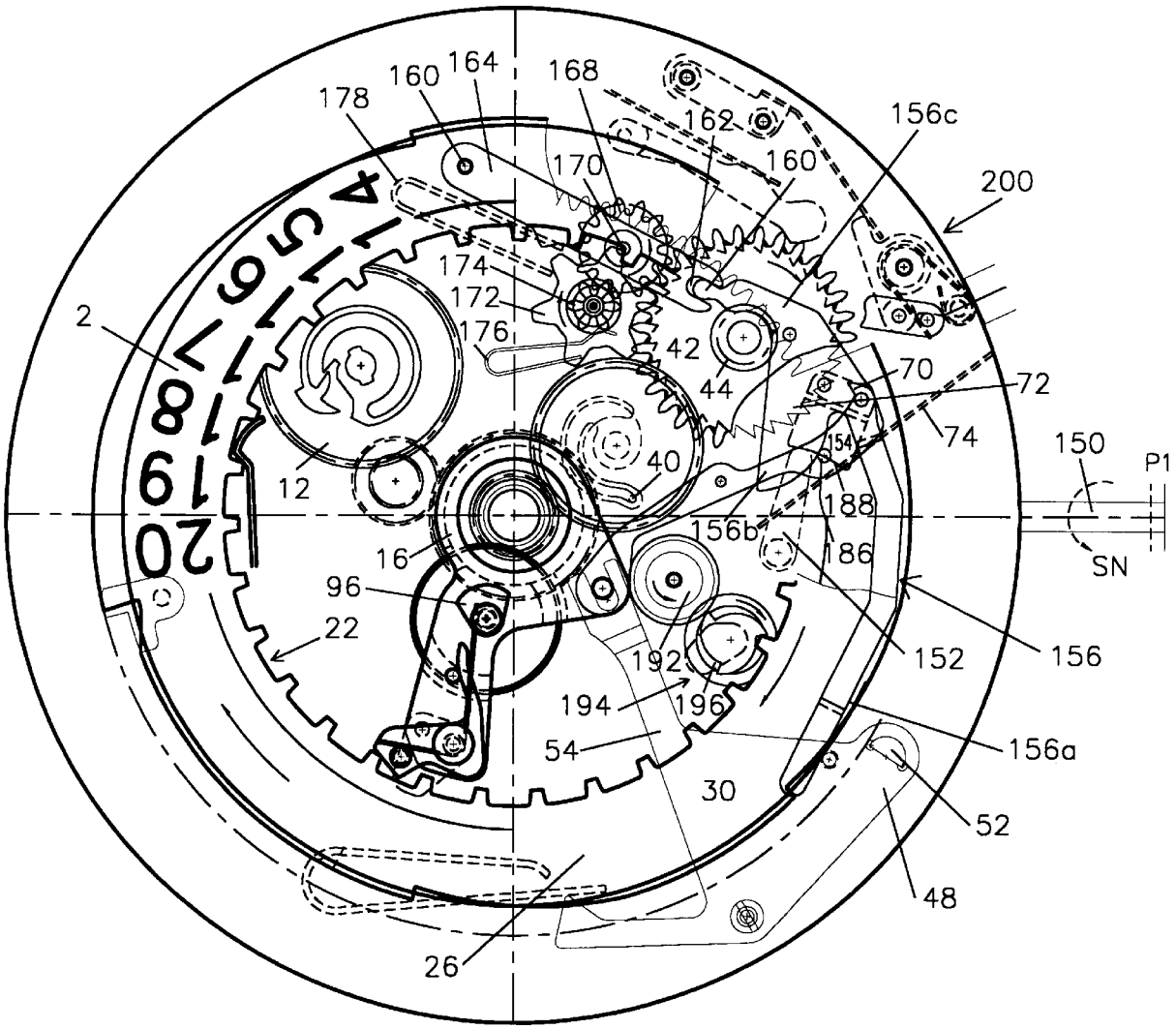
Figure 19:
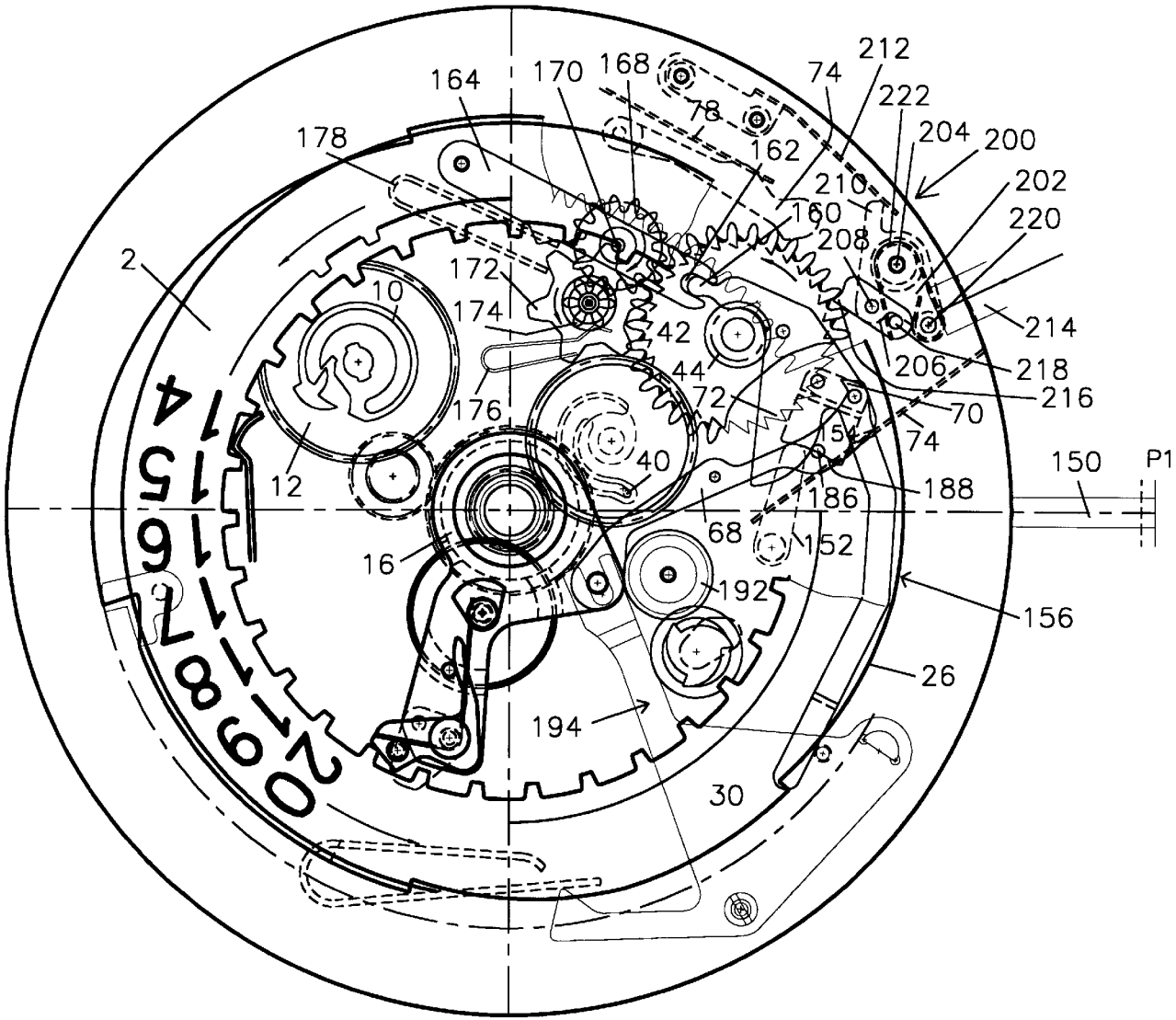
Figure 20:
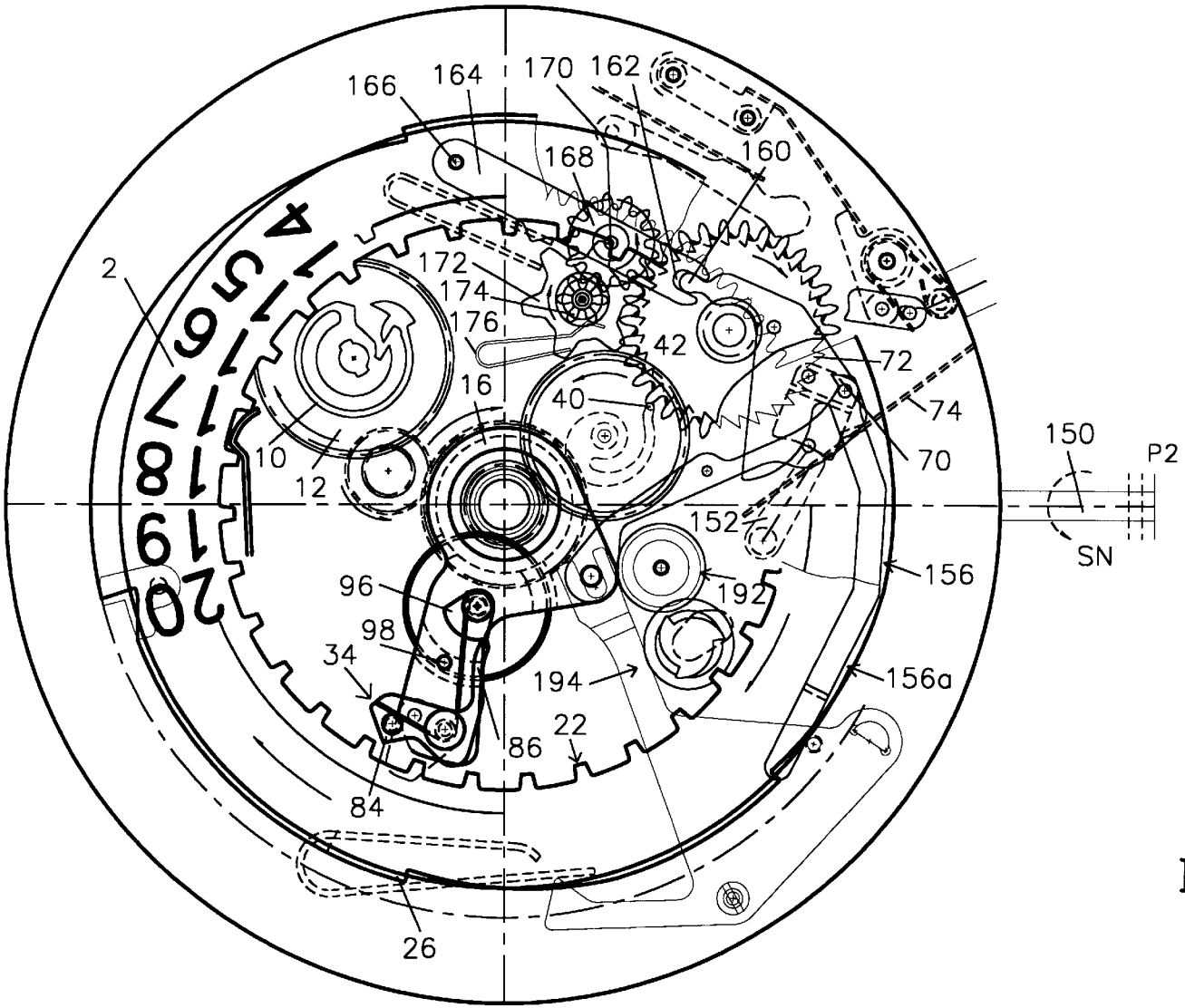
Figure 21:
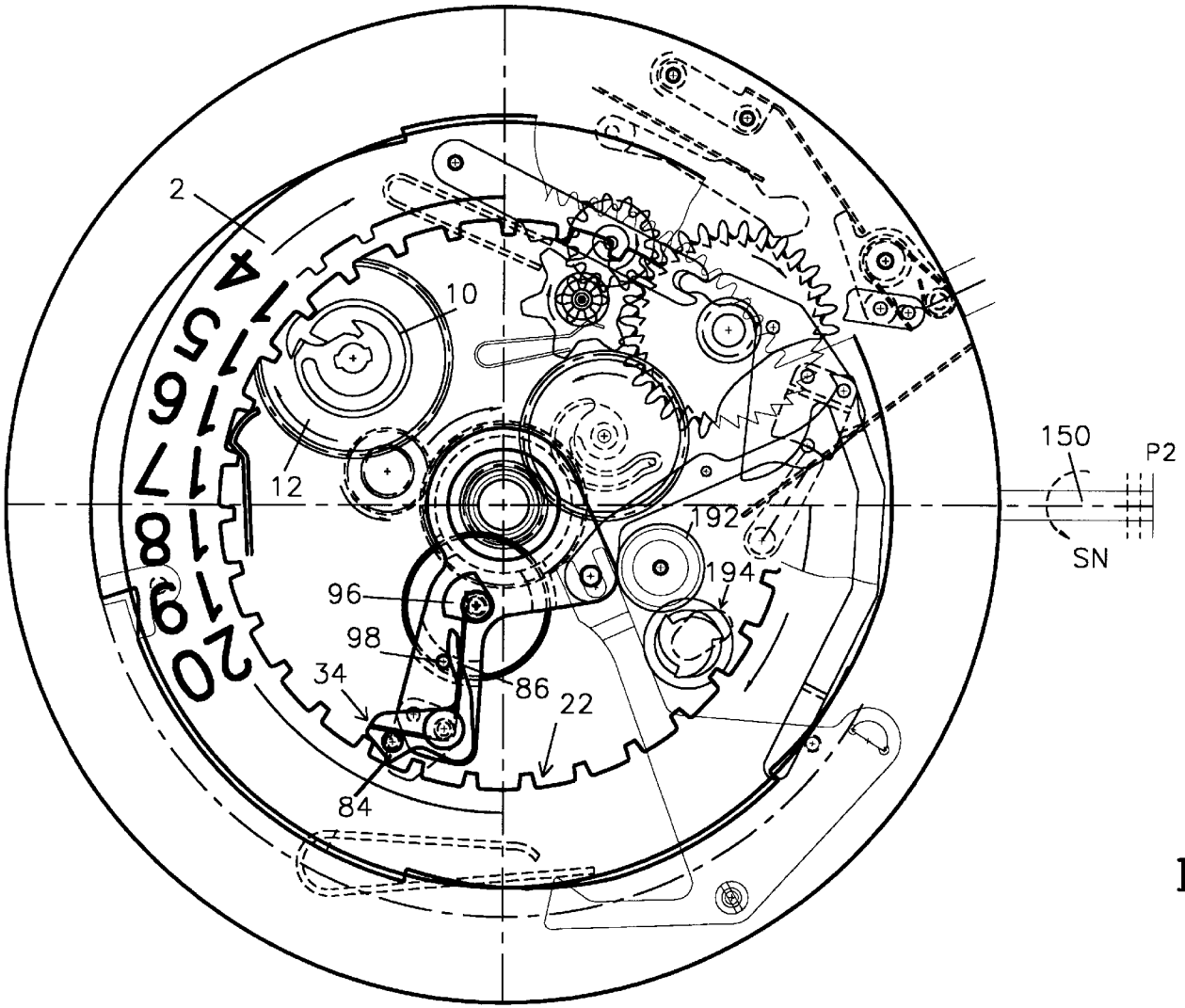
Figure 22:
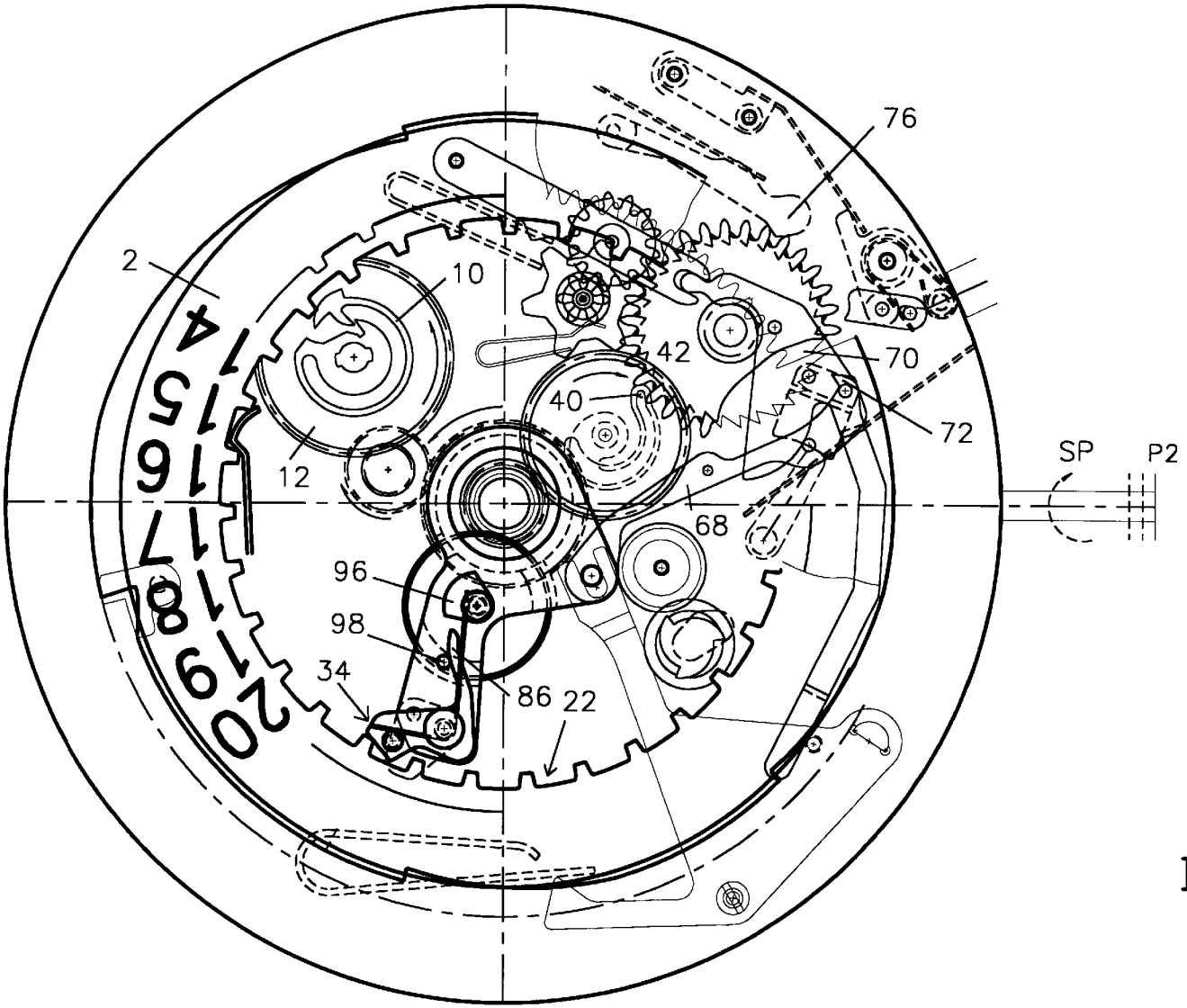
Figure 23:
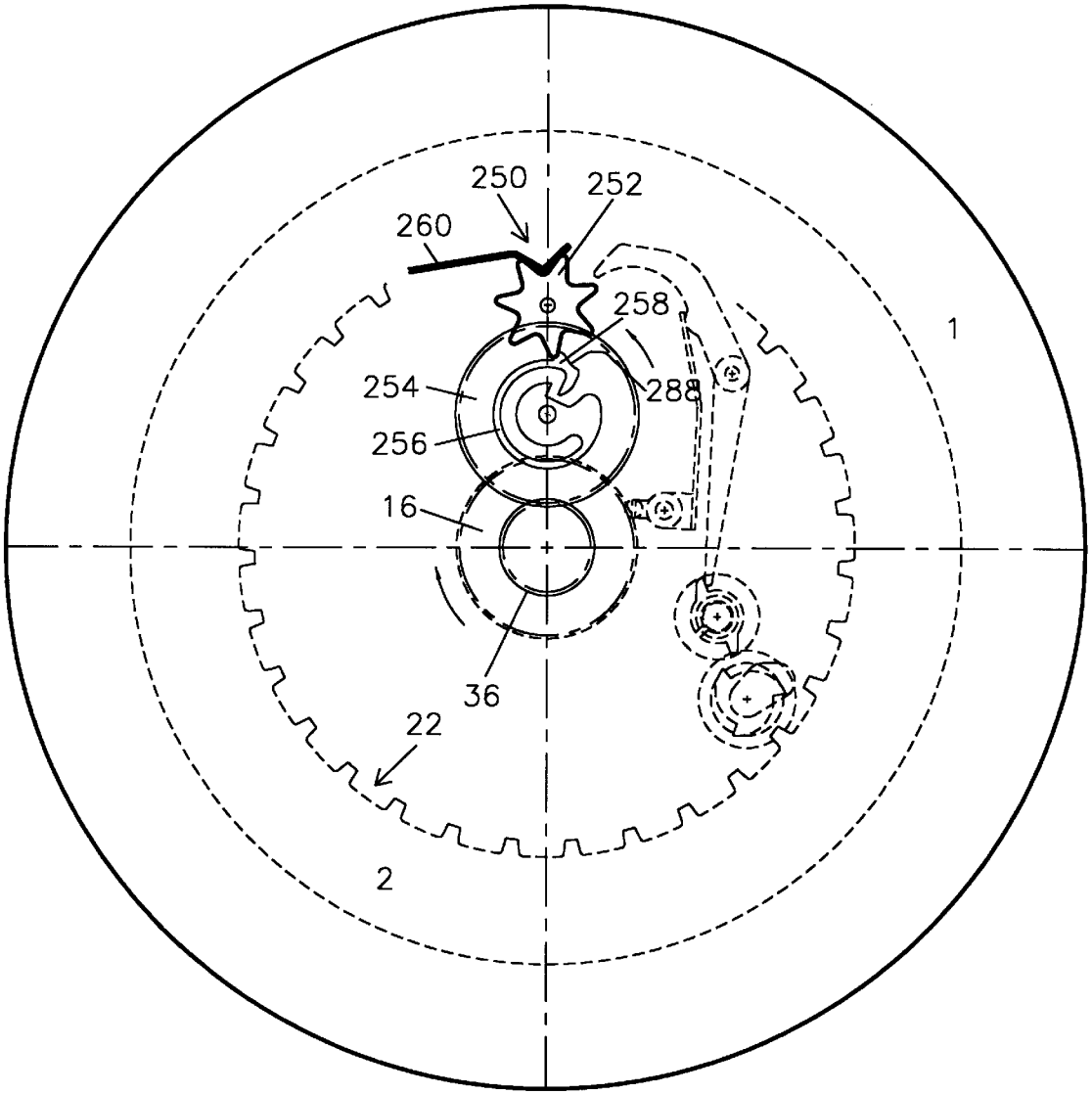
Figure 24:
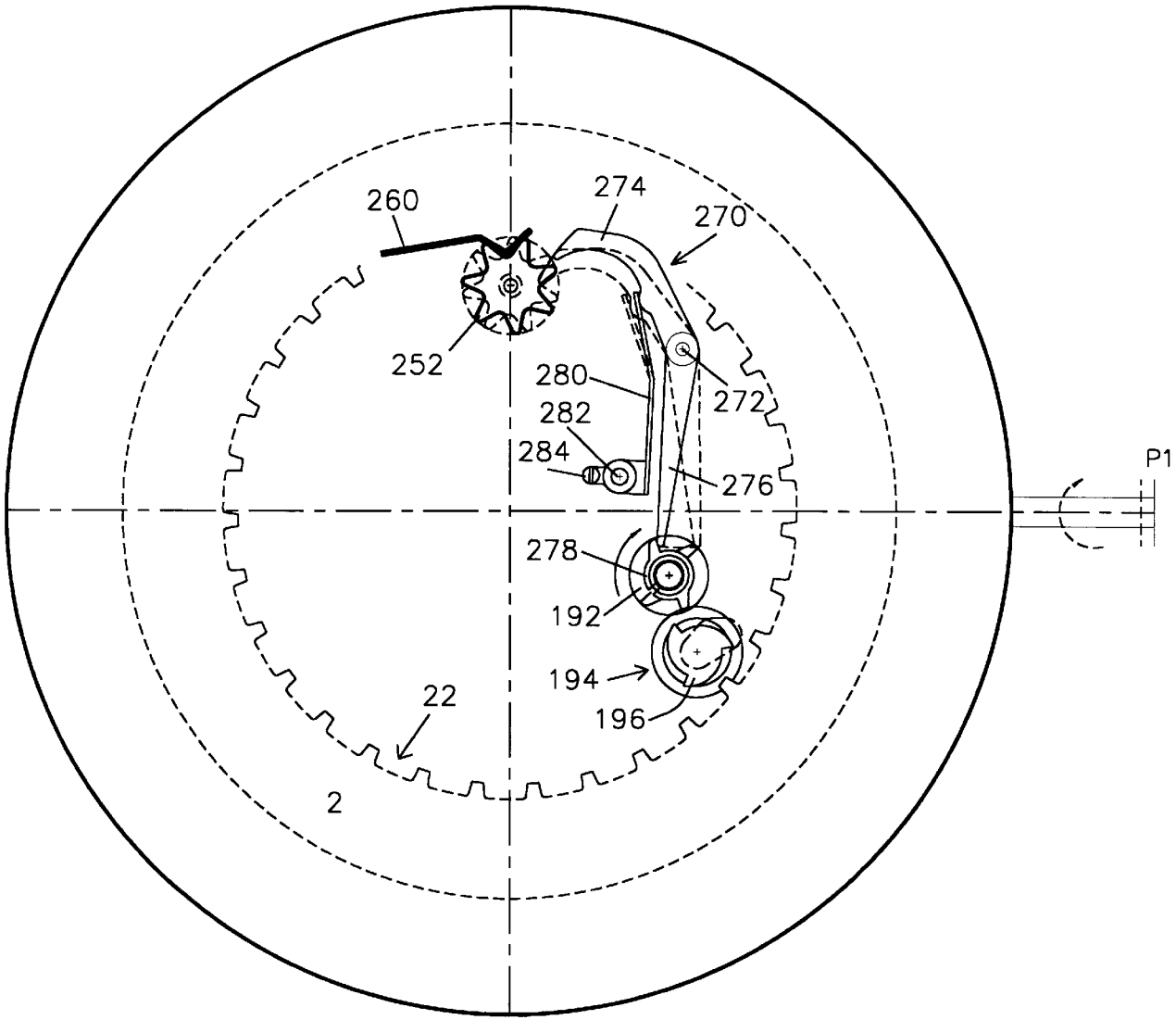

FIGS. 14 and 15 show the condition of the movement after the change from the 29th to the 30th of the month in a leap year, before (FIG. 14) and after the change to the first of the following month (FIG. 15), FIGS. 16 to 19 are views of the top of the movement represented in FIGS. 1 to 15, equipped with a rapid time setting mechanism according to the invention and illustrating the different functions of this mechanism;

FIGS. 20 to 22 are views similar to FIGS. 16 to 19, and show more specifically the correlation between the normal time setting mechanism and the rapid time setting mechanism;

FIGS. 23 and 24 are top views of the movement and of the mechanism according to the invention, but which show only the means for correcting the days as linked to the time setting stem.

Figure 8:
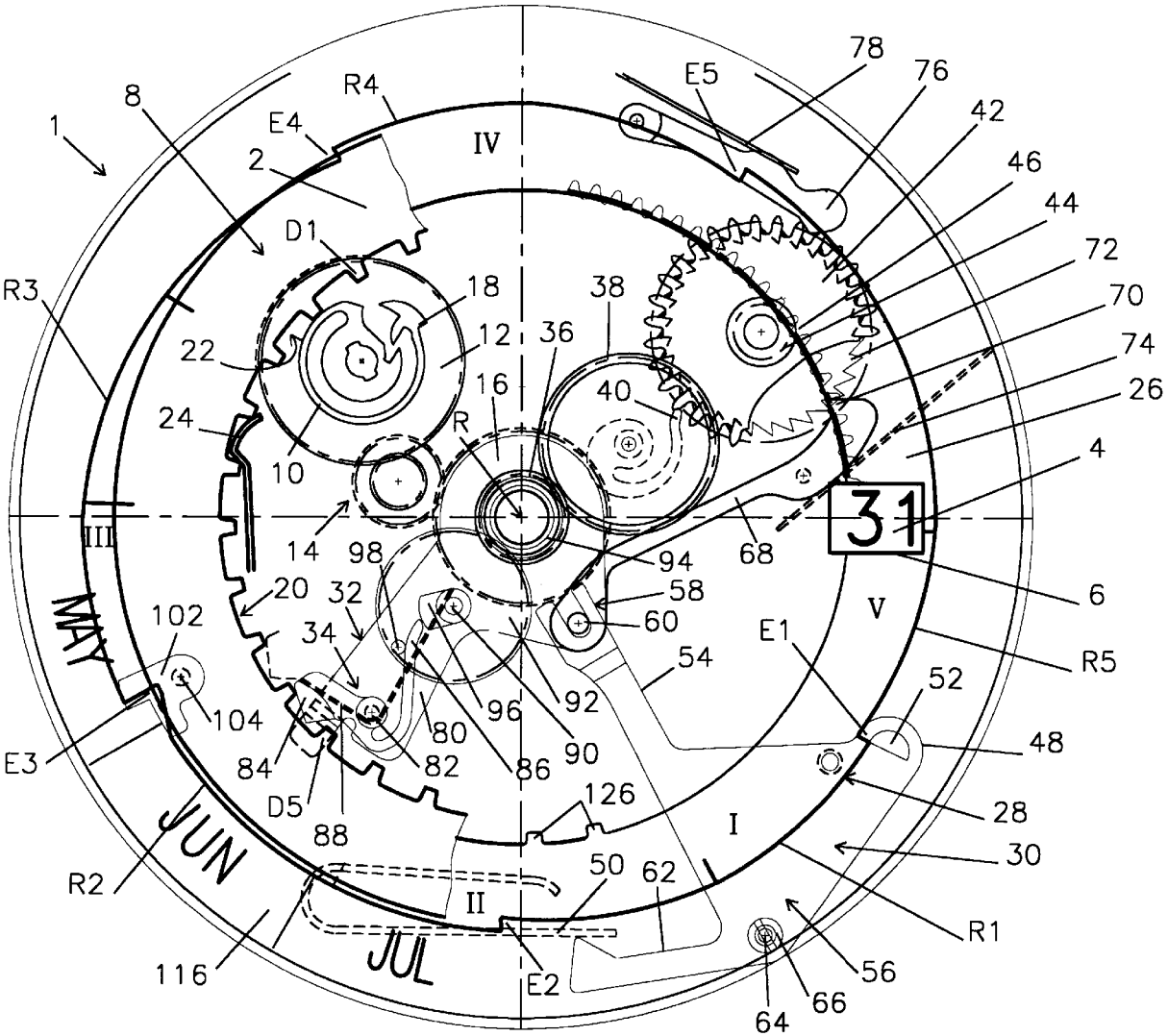

Referring now to FIG. 8, the general principle of a movement intended to be equipped with the mechanism according to the invention will be described below, this movement being designated by general reference 1.

Movement 1 consists of a perpetual date calendar mechanism, including a date ring 2 that carries date information 4. This information appears in a window 6 of a dial, which is not shown.

The ring 2 is associated with a driving device 8, which consists of driving means composed of an elastic arm 10 integrated with a 24-hour wheel, reference The wheel 12 is engaged with a mobile device 14, meshing with an hour cannon wheel 16, which makes one turn in twelve hours.

The elastic arm 10 comprises, at its free end, a hook 18 intended to engage with interior toothing 22 of the date ring 2, in order to make it advance once every 24 hours, when the hook 18 engages with a tooth of this toothing 22.

A jumper spring 24 maintains the date ring 2 in fixed position until the hook 18, made to rotate by the wheel 12, engages on a tooth, for example D1, and winds the elastic arm 10 until it overcomes the force of the jumper spring 24 and almost instantaneously moves the date ring 2 by one jump, for the movement from one day to the next.

It should be noted that device 8 is designed so that after changing to the next day, as explained above, the hook 18 disengages from the toothing 22 in order to allow, if necessary, an additional advancement of the ring 2 so that it can carry out one or more adjusting steps and to take account of months with less than 31 days, with the aid of an adjustment device which will be described below.

The driving device 8 is a conventional device, which will not be described in detail.

Movement 1 consists of an adjustment device with a rotary cam 26 driven at least one step every 24 hours and making one complete turn per year.

The cam 26 is guided in rotation, for example on the surface of the movement, by means not shown and it has a profile 28 intended to guide a sensor 30.

The sensor 30 controls the oscillating movement of a mobile device 32 which is provided with a pawl system 34 intended to make ring 2 advance by the required adjusting step or steps.

The sensor 30 also controls the advancement of the cam 26 in order to make it take a number of steps equal to the number of adjusting steps of the ring 2.

The cam 26 is driven by a gear train connected to the hour wheel 16. More precisely, the hour cannon wheel 16 (hereafter called the hour wheel) has a pinion 36, which engages with wheel 38 of a first mobile element. This first mobile element comprises a finger 40 integrated with the wheel 38. The gearing-down ratio between the pinion 36 and the wheel 38 is such that the wheel 38 makes one rotation in 24 hours. The finger 40 interacts with the toothing of a wheel 42 with 31 teeth, belonging to a second mobile element whose pinion 44 drives the cam 26.

It will be noted that the finger 40 is positioned on the assembly so that it makes contact with the toothing of the wheel 42 after the driving device 8 has allowed ring 2 to jump.

The cam 26 has an annular shape surrounding the mobile assembly 32 and the driving device 8. The cam 26 and the hour wheel 16 have the same axis of rotation R.

The cam 26 has an internal toothing 46 that works together with the pinion 44 to drive this cam in rotation.

The sensor 30, which has the general shape of an anchor, includes a first arm 48, which rests, under the action of a return spring 50, on the profile 28 of the cam 26 by a pallet pin 52.

The pallet pin 52, which is in permanent contact with the profile of the cam 26, has a semi-spherical shape and is located in the vicinity of the free end of the arm 48. This pallet pin 52 is preferably made of a synthetic ruby The sensor 30 has a second arm 54, which is connected to the first arm 48 by a junction piece 56. This second arm 54 is coupled to the mobile assembly 32 by its free end which is fork-shaped 58 and whose teeth are engaged, in the example shown, with a pin 60 that is integrated with the mobile assembly 32.

The sensor 30 includes a third arm 62 extending from the junction piece 56 essentially in the prolongation of the first arm 48, whose end interacts with the spring 50 in order to push the pallet pin 52 in the direction of the profile of the cam 26

To do this, the sensor 30 is set up pivoting by its junction piece 56, via a pivot pin 64, on the movement, tor example on a bottom plate (not shown).

The axis 64 of the sensor 30 is connected to an eccentric 66 that allows the final adjustment of the pallet pin 52 in relation to the profile 28 of the cam 26.

In the example shown, the sensor 30 and the spring 50 generally extend under the cam 26.

The mobile assembly 32 is also associated with a mobile lever 68 which is linked by one of its free ends to the pin 60, this lever 68 being controlled by the sensor 30. The other free end of the lever 68 has a tip 70 engaged with a sawtooth wheel 72. This wheel 72 is integrated with the wheel 44 belonging to the mobile element driving the cam 26. The lever 68 is kept engaged with the wheel 72 through a leaf spring 74, which rests laterally on the back of the tip 70, in a radial direction of the wheel 72.

Furthermore, it will be specified that the wheels 72 and 42, which belong to the mobile element driving the cam 26, are kept in position between each step by a jumper 76, actuated by a spring 78.

The assembly 32 has a base plate 80 mounted in rotation around the axis R, around the hour wheel 16. The base plate 80 extends from the center of the movement in a radial direction toward the ring 2. This plate 80 carries the pawl 34, which is mounted in rotation on it by means of a pivot 82.

The pawl 34 is composed, on the one hand, of a tip 84 intended to engage with the toothing 22 of the ring 2 and on the other hand, of an elastic arm 86 which extends to the top of the plate 80. In this example, the arm 86 extends in the direction of the center of the movement.

The pawl 34 also has a spring 88 acting on the tip 84 to make it enter into the toothing 22 of the ring 2. In the example illustrated, the spring 88 has the general shape of an L which partially surrounds the pivot 82, one branch of which rests against one side of the tip 84, while the other branch rests against a pin 90 integrated with the plate 80.

The pin 90 carries a 24-hour wheel, designated 92, that engages with a pinion 94 integrated with the hour cannon. The pin 90 also carries an inertial cam 96 that is driven by the wheel 92, this inertial cam 96 periodically interacts with the end of the arm 86 to lock it against a pin 98 also supported by the base plate 80.

As will be understood from the detailed description of the functioning of the movement, this arrangement consists of a locking system that, every two months, makes it possible to lock the movement of the arm 86 of the pawl 34 to interrupt it at the moment of the adjusting jump or jumps. Thus, this locking system, in a first position, maintains the tip 84 nearly stationary to ensure that the ring 2 is driven. In a second position, this locking system frees the tip 84 to assure its ratchet function for the ring 2, when the ring is actuated, in particular by the driving device 8.

The profile 28 of the cam 26 is composed of five contiguous sectors, designated as I to V, connected to each other by recesses forming notches E1 to E5. The depth of these notches determines the radial displacement of the sensor 30, and particularly the radial displacement of the pallet pin 52 to make the ring 2 carry out the number of adjusting steps at the end of months having less than 31 days.

The five sectors I to V form continuous ramps R1 to R5 that extend in the counterclockwise direction, from the bottom of a notch $E_n$ to the top of a following notch $E_{n+1}$, from a first radius to a second radius greater than the first.

One of the notches, designated E3, is deeper than the other four notches E1, E2, E4 and E5, which are of equal depth.

The notches E1, E2, E4 and E5 have depths that allow them to move the sensor 30 to control, via the mobile assembly 32, the displacement of the ring 2 by one adjusting step at the end of months with 30 days (April, June, September, November), while the notch E3 has a depth that allows it to move the sensor 30 to also control, via the mobile assembly 32, the displacement of the ring 2 by two or three adjusting steps, respectively at the end of months with 29 and 28 days (February, leap year and non-leap year).

To this end, the depth of the notch E3 is not constant. It is associated with a system 100 capable of varying its depth once every four years. This system 100, seen in FIG. 13, consists of a mobile flap 102 mounted in rotation on the cam 26 by means of a pin 104. The pin 104 carries a wheel 106, which makes one turn every four years, this wheel being actuated on each complete rotation of the cam for a quarter turn. For this, the system 100 interacts, once a year, with a fixed finger of the movement, designated 108. Thanks to this arrangement, the mobile flap 102 can close the notch E3 once every four years in order to reduce its depth. This makes it possible to limit the displacement of the sensor 30 so that it only has the ring 2 make two adjusting steps at the end of the month of February in leap years.

Furthermore, the mobile flap 102 has a shoulder, which when the mobile flap closes the notch E3 once, lengthens the ramp R3 by a distance corresponding to a day.

The wheel 106 is maintained in position by an L-shaped jumper 110, mounted in rotation by means of a pivot 112 which is supported by a crown 116, forming a month ring and integrated with the cam 26.

This jumper 110 interacts with a return spring 114 which acts on one of the branches of the L so that the other branch enters between two teeth of the wheel 106, this second branch having an end provided for this purpose. Thus, the jumper 110 and its spring 114 turn with cam 26 at the rate of one complete turn per year.

FIG. 13 also shows a device for displaying leap years 120, which can advantageously equip the movement 1.

The device 120 consists of a star 122 carrying a year display hand (not shown), this hand pivoting on the movement 1. The star 122 is maintained by a jumper spring 124 ensuring the position of the hand. In the example shown, the star 122 has eight branches and is driven by two driving teeth 126 integrated with the cam 26. Thus the star 122 is controlled, once a year, by these two teeth to make a quarter turn at every complete rotation of the cam. This display is invaluable for showing leap years.

Referring to FIGS. 1 to 15, the functioning of the movement will be described below.

Figure 1:
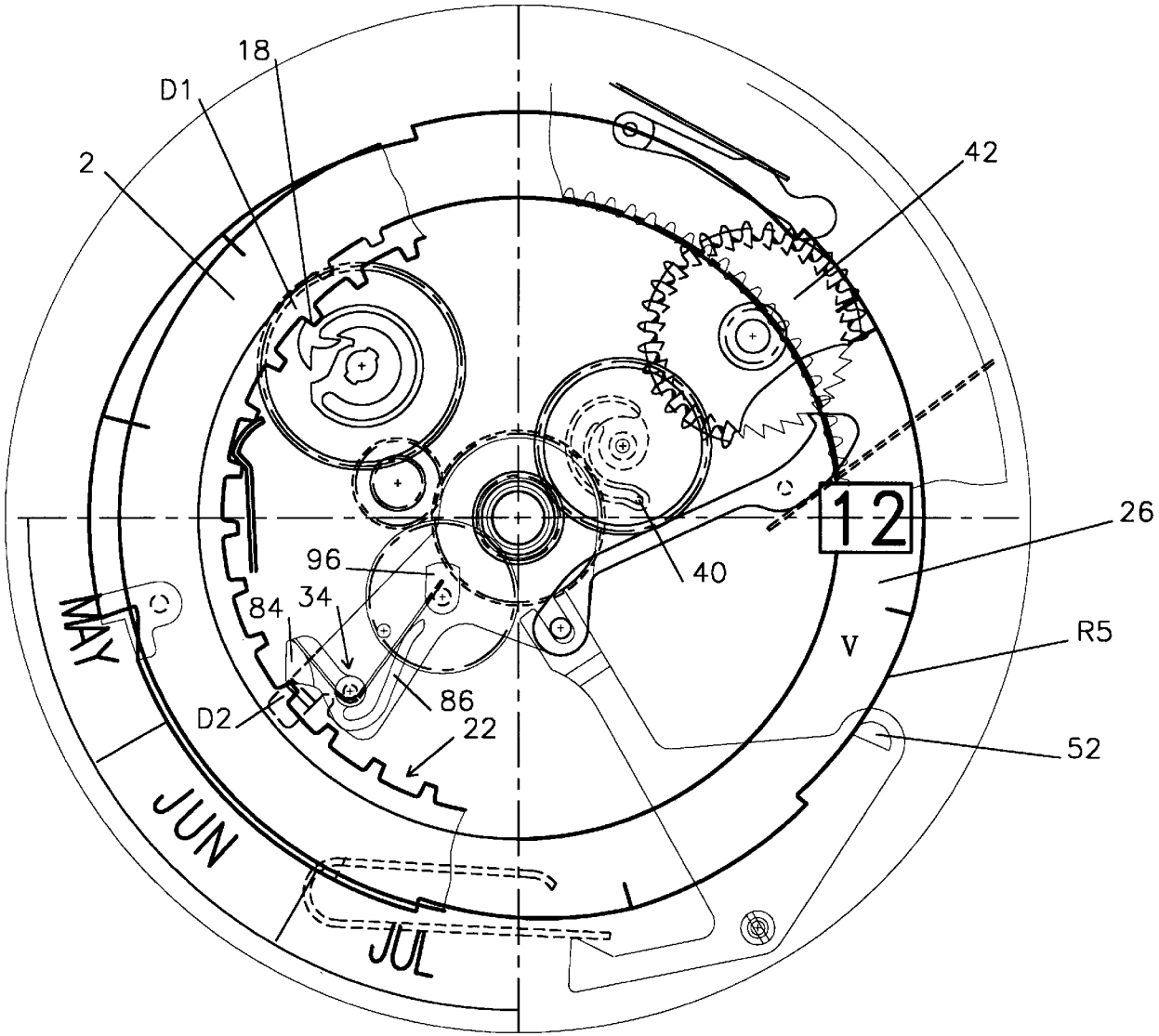
FIGS. 1 to 6 are top views of the movement according to the invention, and show the conditions of the movement before (FIGS. 1 and 2), during (FIG. 3) and after (FIGS. 4, 5 and 6) the change of a day, for example in the middle of a month, such as the 12th, to the next day.

In FIG. 1 the conventional date drive device is seen at 21:00 hours, that is at the start of its winding to trigger a normal jump, on changing from the 12th to the 13th of the month.

The hook 18 of the elastic arm 10 hits against a tooth D1 of the toothing 22. The pallet pin 52 is in the process of going up the ramp R5. The inertial cam 96 has not reached the end 86 of the pawl 34. The tip 84 can thus rise slowly on the side of a tooth D2. The pawl 34 is therefore free and allows either the function of future changing of the date or a rapid resetting of the date by means of a device that is not described.

Furthermore, the end of finger 40 has not yet, at this time, reached one of the teeth of the 31-tooth wheel 42.

Figure 2:
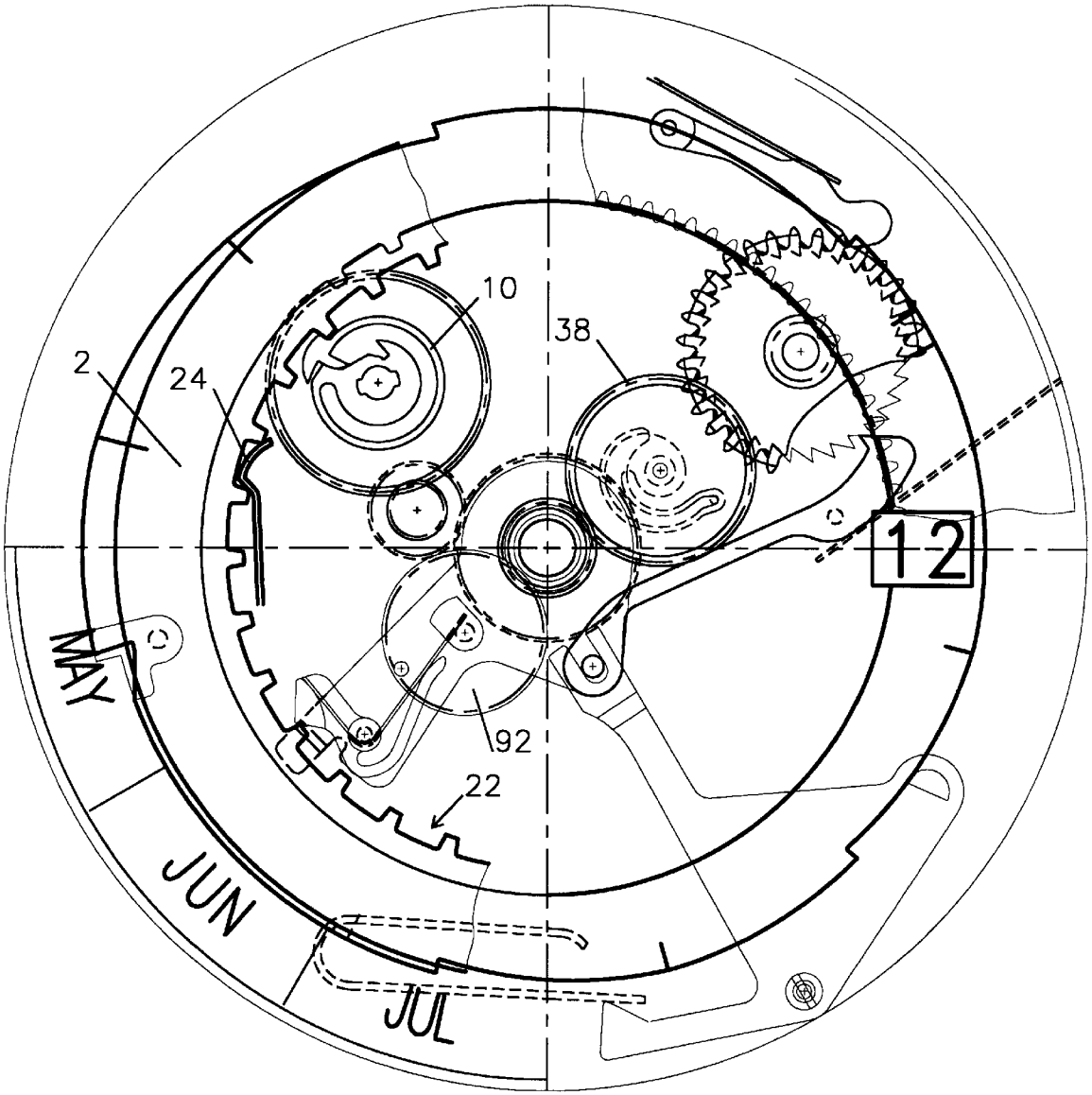

In FIG. 2, the conventional date driving device is seen at 23:30 hours. The elastic arm 10 of the driving means has continued its winding without the ring 2 having moved as yet, it being held by the jumper spring 24. The two 24-hour wheels, designated respectively 38 and 92, have traveled through the complementary angle corresponding to the time that has elapsed between 21:00 and 23:30, without any other function taking place.

Figure 3:
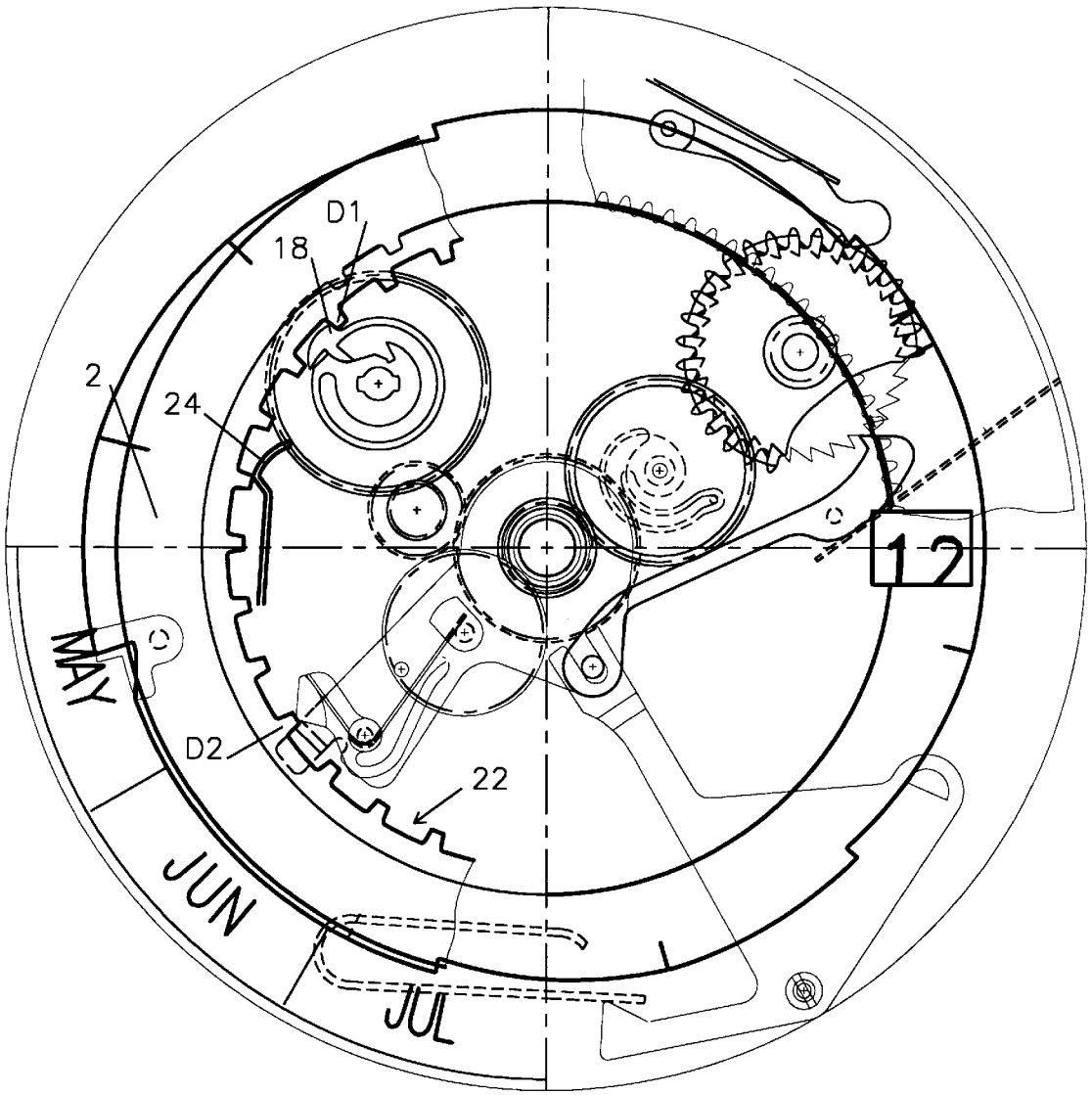

In FIG. 3, the conventional date driving device is seen at midnight, the ring 2 being ready to jump one step. The hook 18 has made the ring 2 advance during the half hour preceding midnight. The jumper spring 24 has risen during this short period. It still holds the ring 2.

Figure 4:
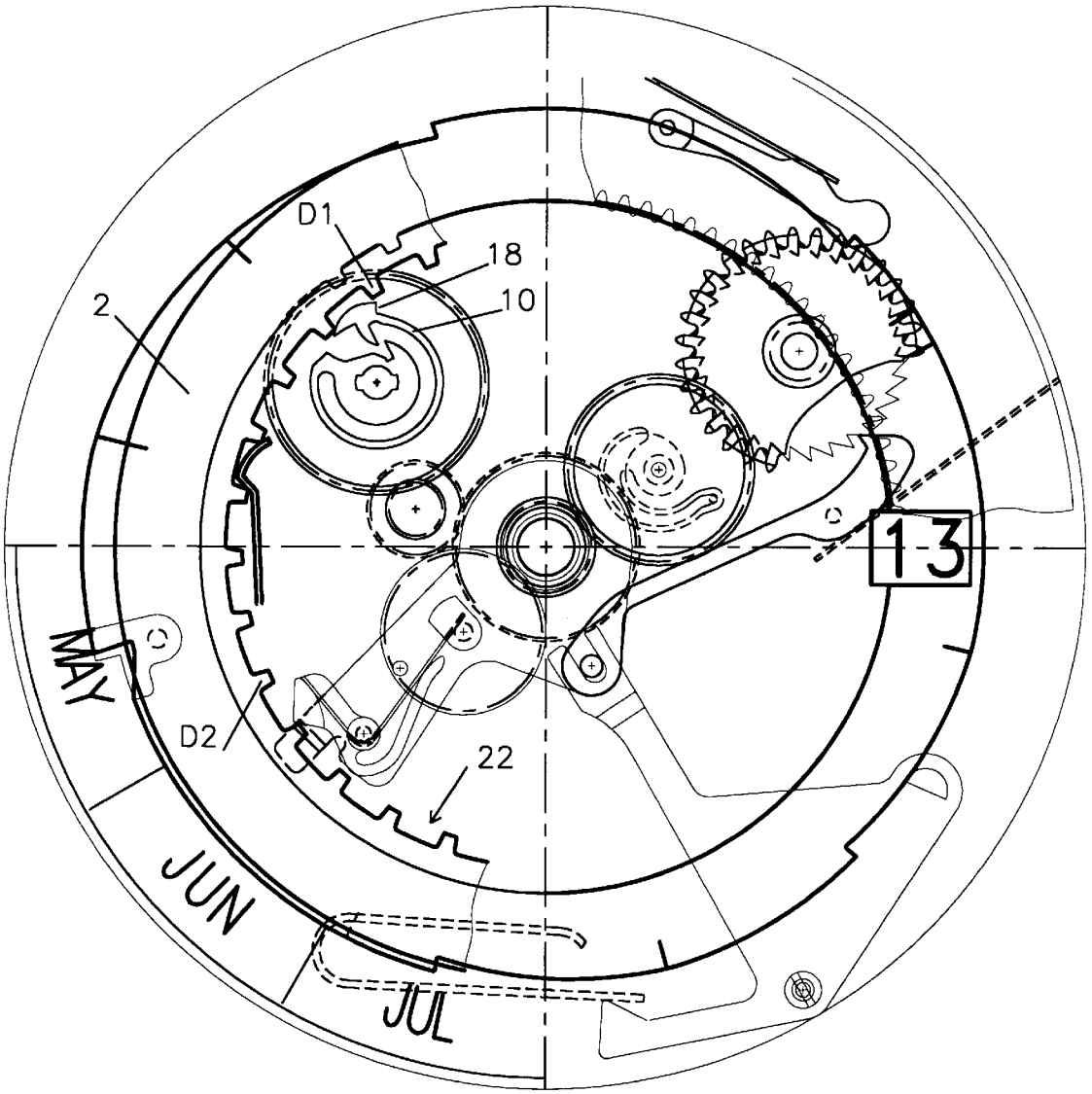

In FIG. 4, the driving device is seen just after the jump of the ring 2, that is, after the change to the 13th day of the month. The elastic arm 10 of the driving means has returned to its shape at rest. The hook 18 starts to disengage from the toothing 22 to allow the future rotation of the ring 2, at the end of months with less than 31 days.

Figure 5:
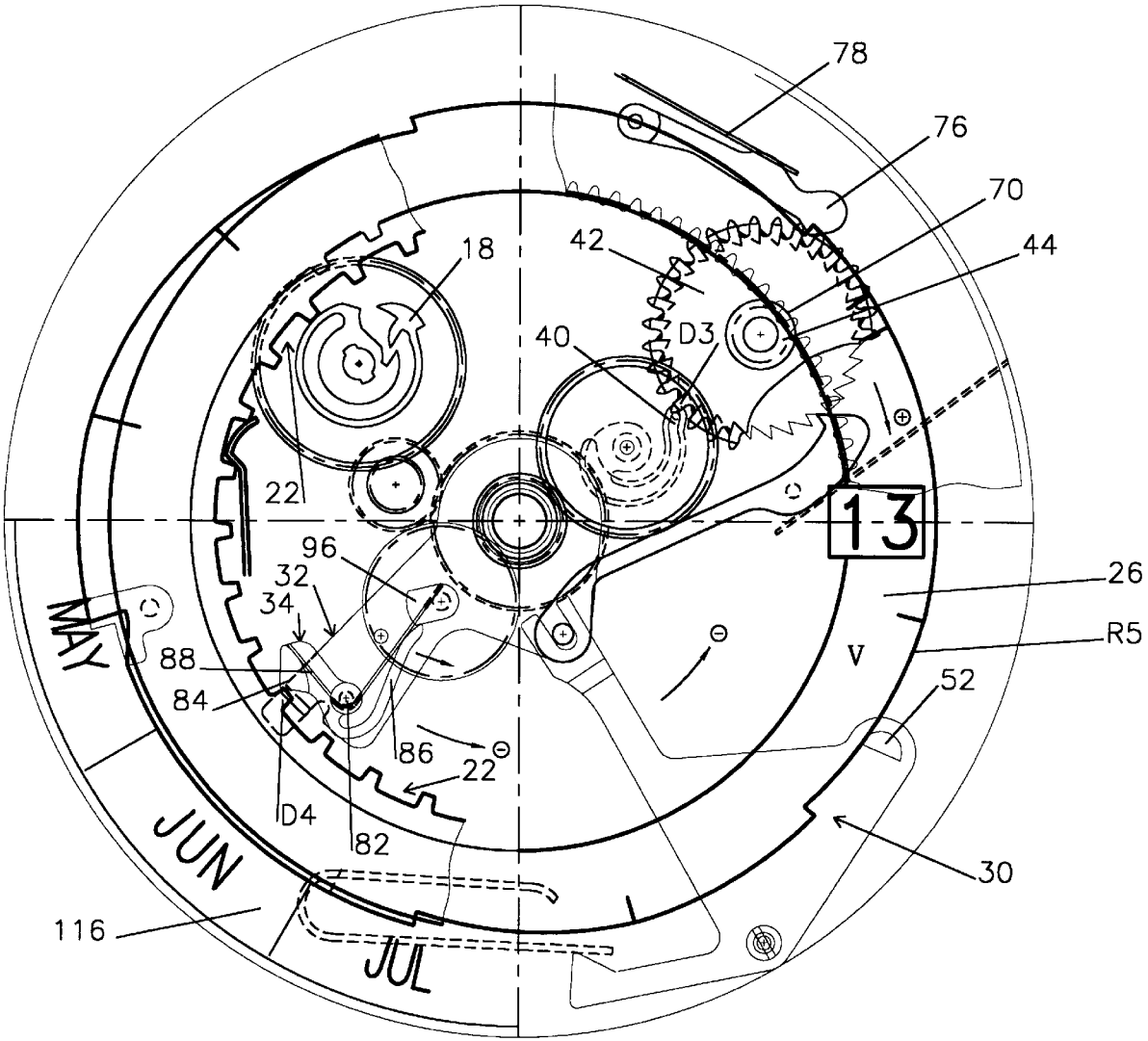

In FIG. 5 the condition of the movement is seen after the above-mentioned jump at 2:00 a.m. The hook 18 of the elastic arm 10 is completely disengaged from the toothing 22. The end of the finger 40 drives a tooth D3 of the 31-day wheel 42, until the moment when the return force of the jumper 76 will be overcome by the movement of finger 40 and will end the driving function of this wheel 42 through the action of the spring 78.

The pinion 44, which is integrated with the wheel 42, drives the cam 26 in rotation by means of the internal toothing 70 of this cam. Thus, the cam 26 which is integrated with the ring 116 will have taken an additional step of 1/372nd of a turn in the clockwise direction, thus causing the pallet pin 52 to rise on the ramp R5, slowly moving the sensor 30 in the counterclockwise direction, while the sensor 30 drives the mobile assembly 32 in its movement.

During this period, the point of the tip 84 has risen against the side of a tooth D4 of the toothin 22 of the ring 2. The arm 86 has moved angularly around its axis 82, the end of this arm being pushed by the inertial cam 96 and removing the tip 84 from the toothing 22.

The end of the arm 86 moves until the time when, by 24 hour rotation of the inertial cam 96, the cam 96 will let the pawl 34 fall again into the toothing 22, by the effect of the spring 88. During this period, the ring 2 is free to turn, particularly from the effect of a rapid setting of the date.

Figure 6:
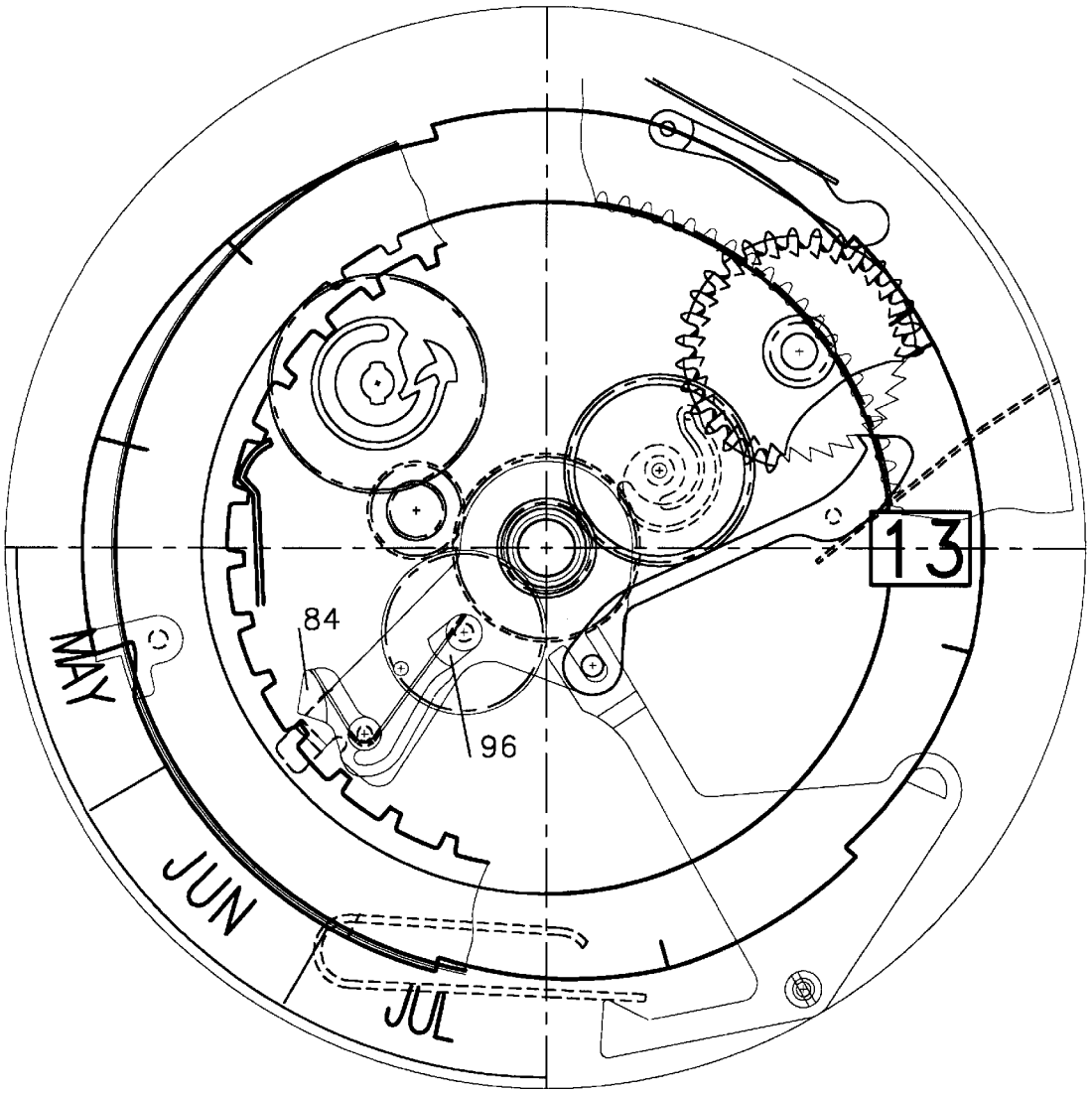

The maximum displacement of the pawl 34 is reached, in this configuration, at about 4:00 a.m., as FIG. 6 shows, presenting at that moment the position of the other mobile elements in movement.

Figure 7:
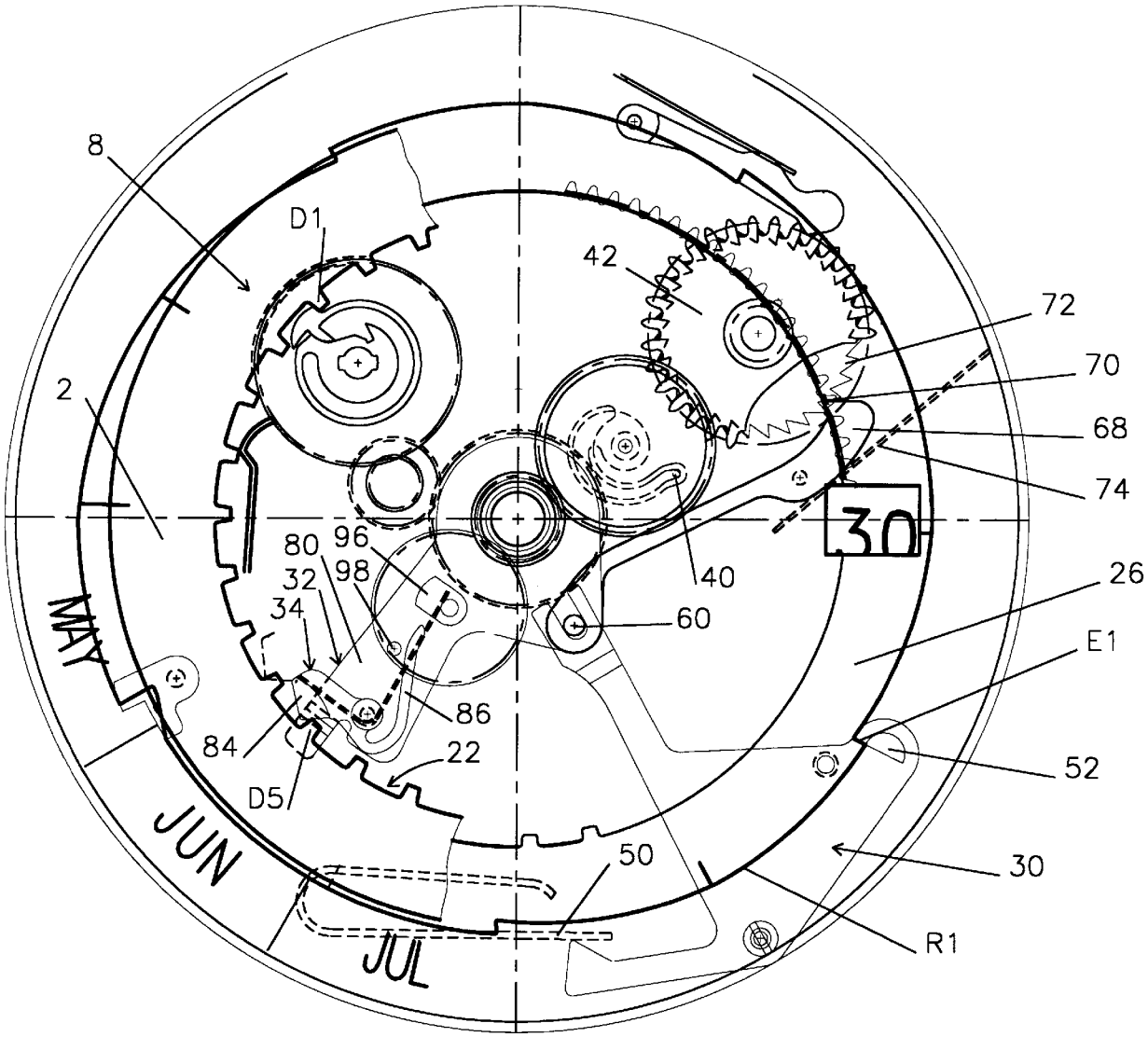
FIGS. 7 to 9 are views similar to FIGS. 1 to 6, but show conditions of the movement before (FIG. 7), during (FIG. 8) and after (FIG. 9) the change of a day at the end of a month with 30 days to the 1st of the next month.

FIG. 7 shows the movement under the same conditions as those previously described for FIG. 3, but this time before the adjusting step of ring 2 for the change from the 30th to the 31st of the month, for a 30 day month.

During the period that follows, the inertial cam 96 will position itself in front of the end of the arm 86 to lock it against the pin 98 in order to immobilize the pawl 34 with respect to the base plate 80. At that time, the tip 84 of the pawl enters completely into the toothing 22 of the ring 2.

At the same time, the articulated lever 68 is moved slowly by the action of the sensor 30, via the pin 60, to rise on the toothing of the wheel 72. The head 70, of this lever, came to settle in the next tooth gap of wheel 72, through the effect of the spring 74.

It will be noted that the pallet pin 52 remains on the edge of the notch E1 of the cam 26 on the ramp R1.

As in FIGS. 1 to 5, the driving device 8 will be wound and, around midnight, will make the ring 2 turn for the jump from 30 to 31, as seen in FIG. 8.

FIG. 8 shows the movement's position at 2:00 a.m., just before it makes the adjusting step from the 31st to the 1st.

The hook 18 is completely disengaged from the toothing 2. At this time, the pawl 34, and more particularly its tip 84, is immobilized on the base plate 80 by the inertial cam 96, and the pallet pill which is on the edge of the notch E1 is ready to fall into this notch.

Figure 9:
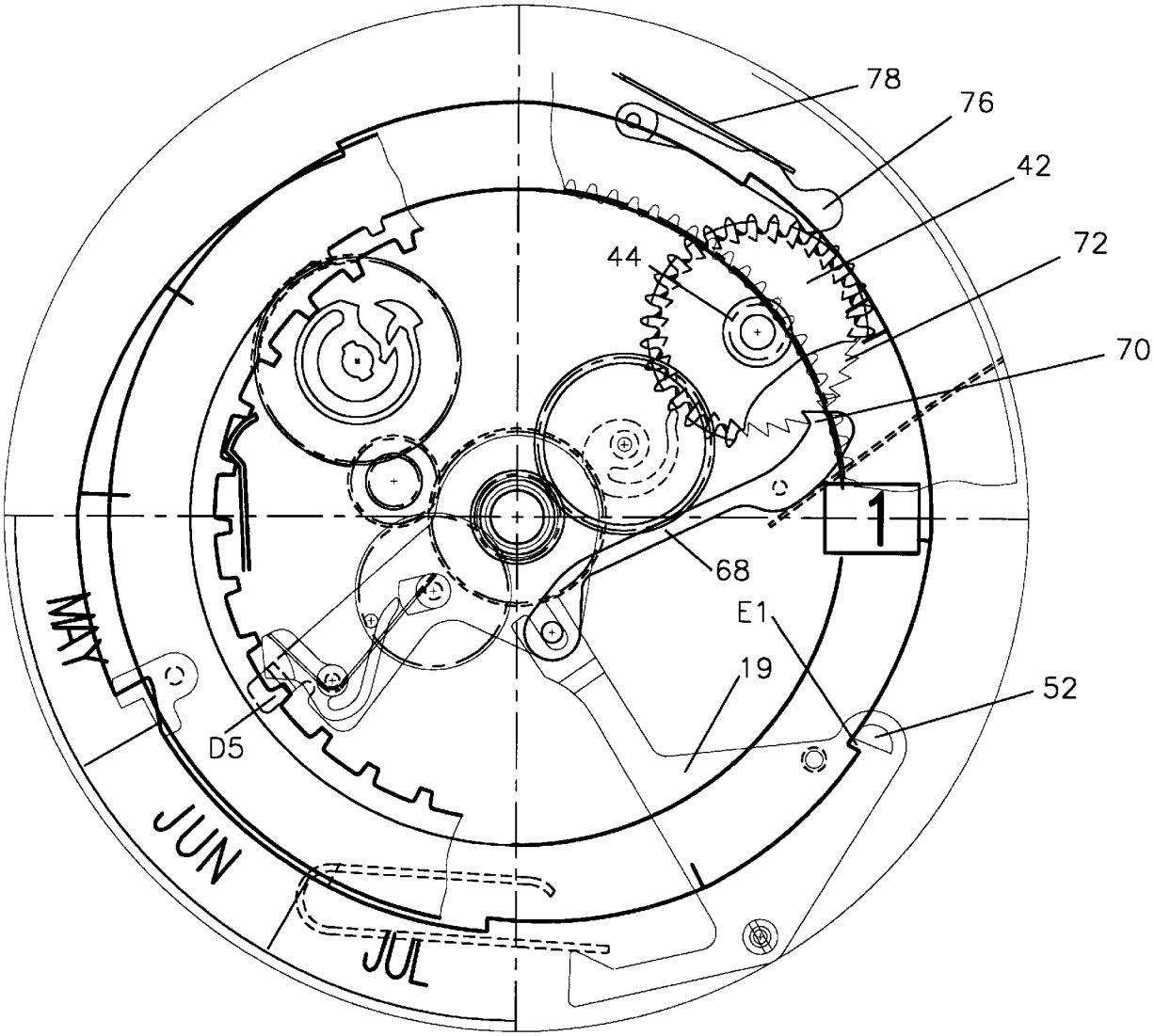

The finger 40 then drives the wheel 42 by one step to advance the cam 26 by a corresponding step. The advance of the cam 26 leads to the fall of the pallet pin 52 into the notch E1, through, the effect of the spring 50. In its course, the sensor 30 moves the mobile assembly 32 in rotation, which then advances the ring 2 by one adjusting step, thanks to the tip 84 which is immobilized by the inertial cam 96 (FIG. 9).

It will be noted in this respect that during the adjustment step, the inertia of ring 2 is not controllable, the more so as the energy distributed by the sprint, 50 varies according to its winding, which itself depends on the depth of the notches E1 to E5. The solution to this problem consists of locking the pawl 32 by the inertial cam 96, as mentioned above. This locking takes place at the time when the adjusting jump takes place, thus maintaining the tip 84 in the toothing 22 of the ring 2.

Thus after the ring 2 advances a step, the preceding tooth D5 hits against the heel of the tip 84, thus preventing the ring 2 from advancing an additional step Furthermore, it will be specified that, given that the inertial cam 96 is always turning, the pawl 32 is free for most of the time and in particular at the time of the traditional change of date at midnight. However, if a rapid change of date should take place at the time when the cam is locking the elastic arm 86, particularly between the period following the traditional jump to midnight and the adjusting jump at the end of the month, the elastic arm 86 has the flexibility necessary to pass over one or more teeth of the toothing 22 above the point of the pawl 84.

To comment further on the foregoing, it will be stated that during the successive days of 31-day months, the pallet pin 52 rises progressively along the length of the ramps R1 to R5 of the cam 26. During this course which represents, in the case of the ramp R1, the interval between two months, the spring 50 has been progressively stretched by the arm 62 of the sensor 30 and has wound the sensor 30 so that it falls into the notch E1, when the finger 40 will have controlled the displacement of the cam 26. When the sensor 30 moves along the ramp R1, it pivots around its axis 64 and causes an angular displacement of the mobile assembly 32, via the pin 60. When the sensor 30 goes up the ramp R1, it pivots in the clockwise direction and displaces the mobile assembly 32 angularly. At the time when the pallet pin 52 falls into the notch E1, the sensor 30 pivots around its axis 64 in the counterclockwise direction and displaces the mobile assembly 32 angularly in the clockwise direction, which makes the ring 2 take the adjusting step required. The tip 84 of the pawl 34, which is immobilized by the inertial cam, then pushes the toothing 22 in the clockwise direction. Simultaneously, the rotational movement of the sensor 30 causes the rotation of the wheel 72, by traction on the lever 68. The wheel 72 being integrated with the pinion 44, the traction movement of the lever 68 also causes the rotation of the cam 26 with the same adjusting step, so that this cam 26 remains in phase with the periods of the following months.

FIG. 9 shows the condition of the movement after the adjusting step when changing, from the 31st to the 1st, at the end of a 30-day month.

At the time of the step, when the sensor falls into the notch E1 the articulated lever 68 by driving, its head 70 turns the mobile element of the wheels 42, 72, and 44 by one step. Thus the pallet pin 52 did not fall directly to the bottom of the notch E1, but at a distance from the vertical wall of the notch E1, this distance corresponding to one day at the end of a 30-day month.

Figure 10:
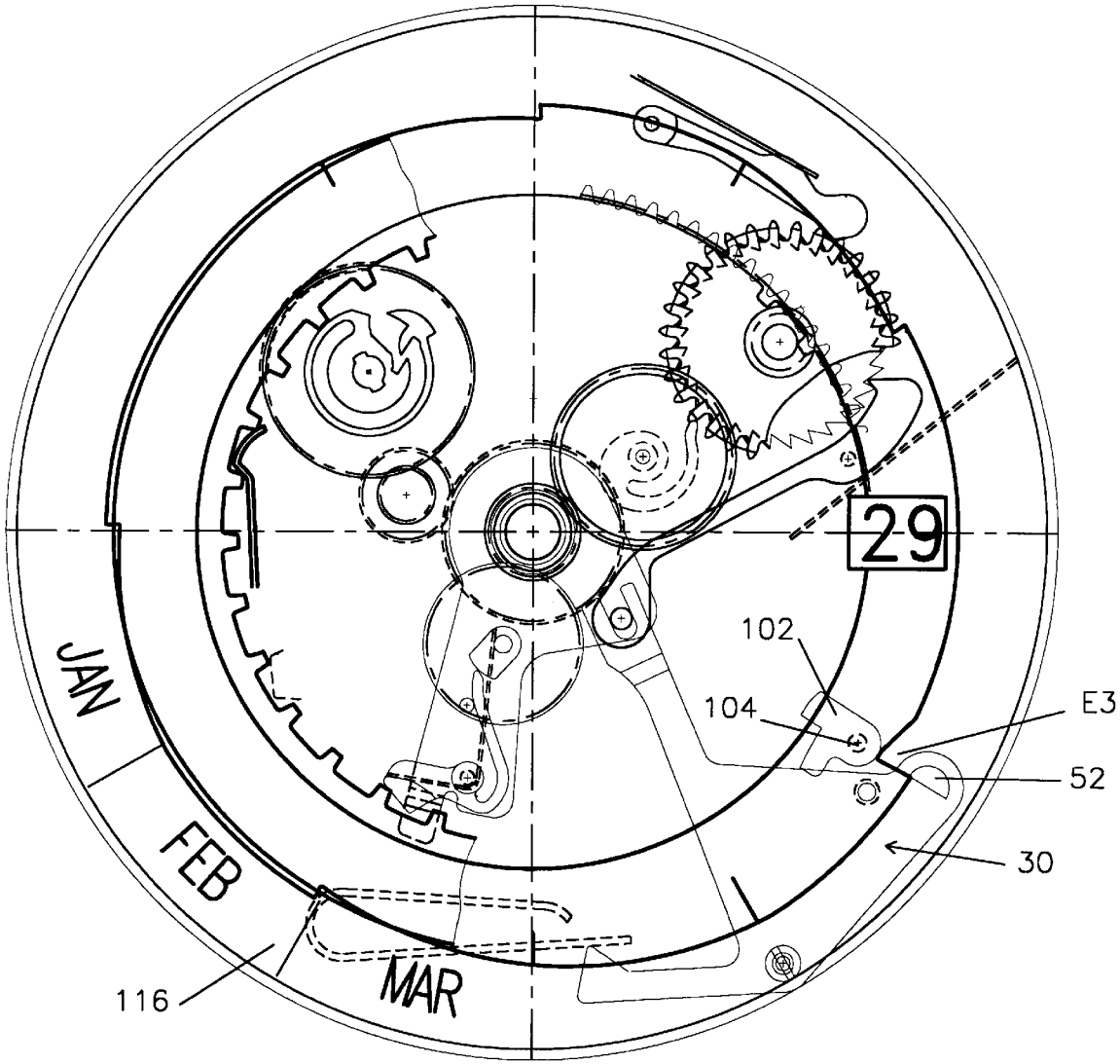
FIGS. 10 and 11 are views similar to those in FIGS. 7 to 9, but show the conditions of the movement before (FIG. 10) and after (FIG. 11) the change from the 29th of the month to the first of the following month, for a February month of 28 days (not a leap year)
Figure 11:
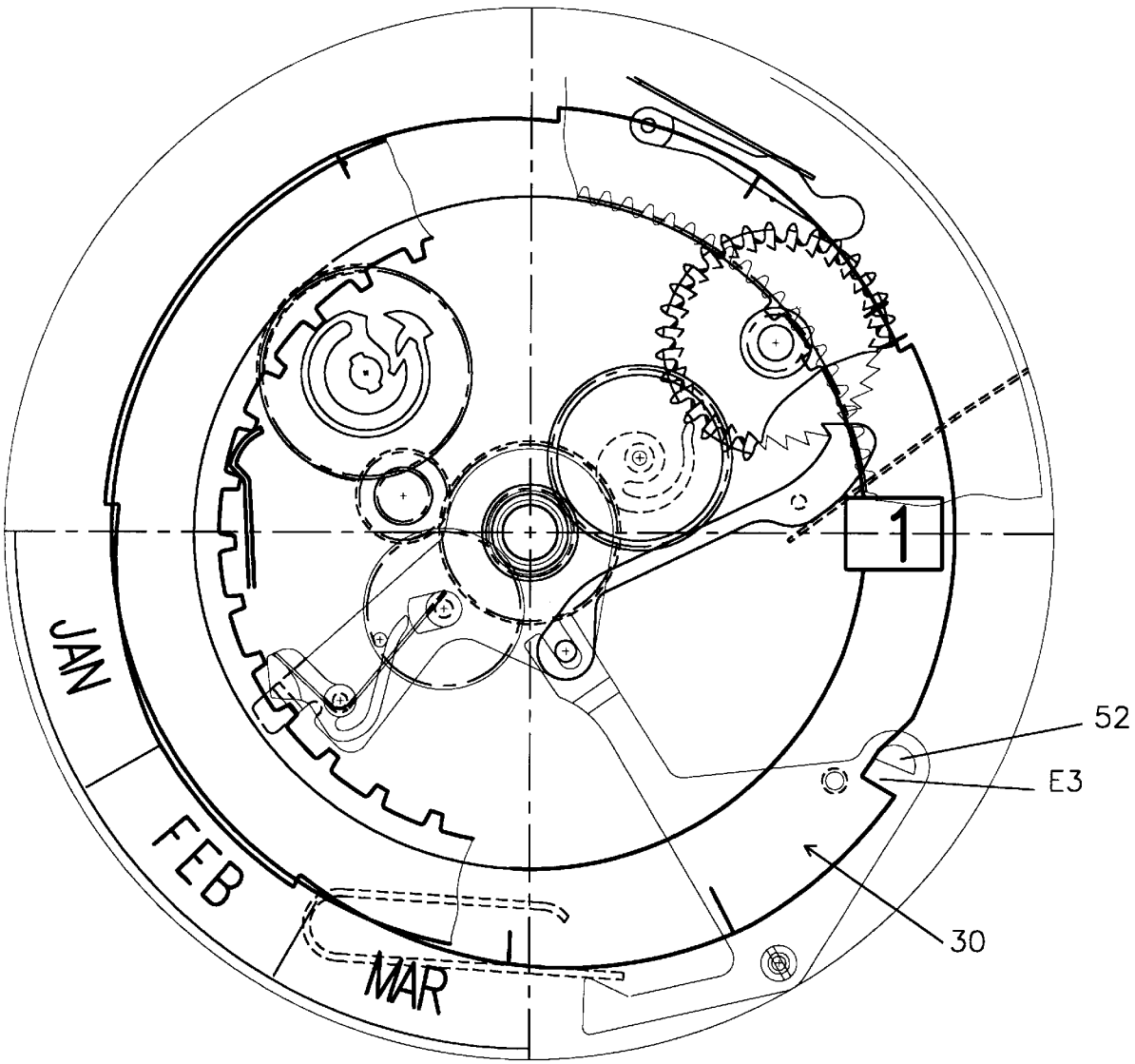
Figure 12:
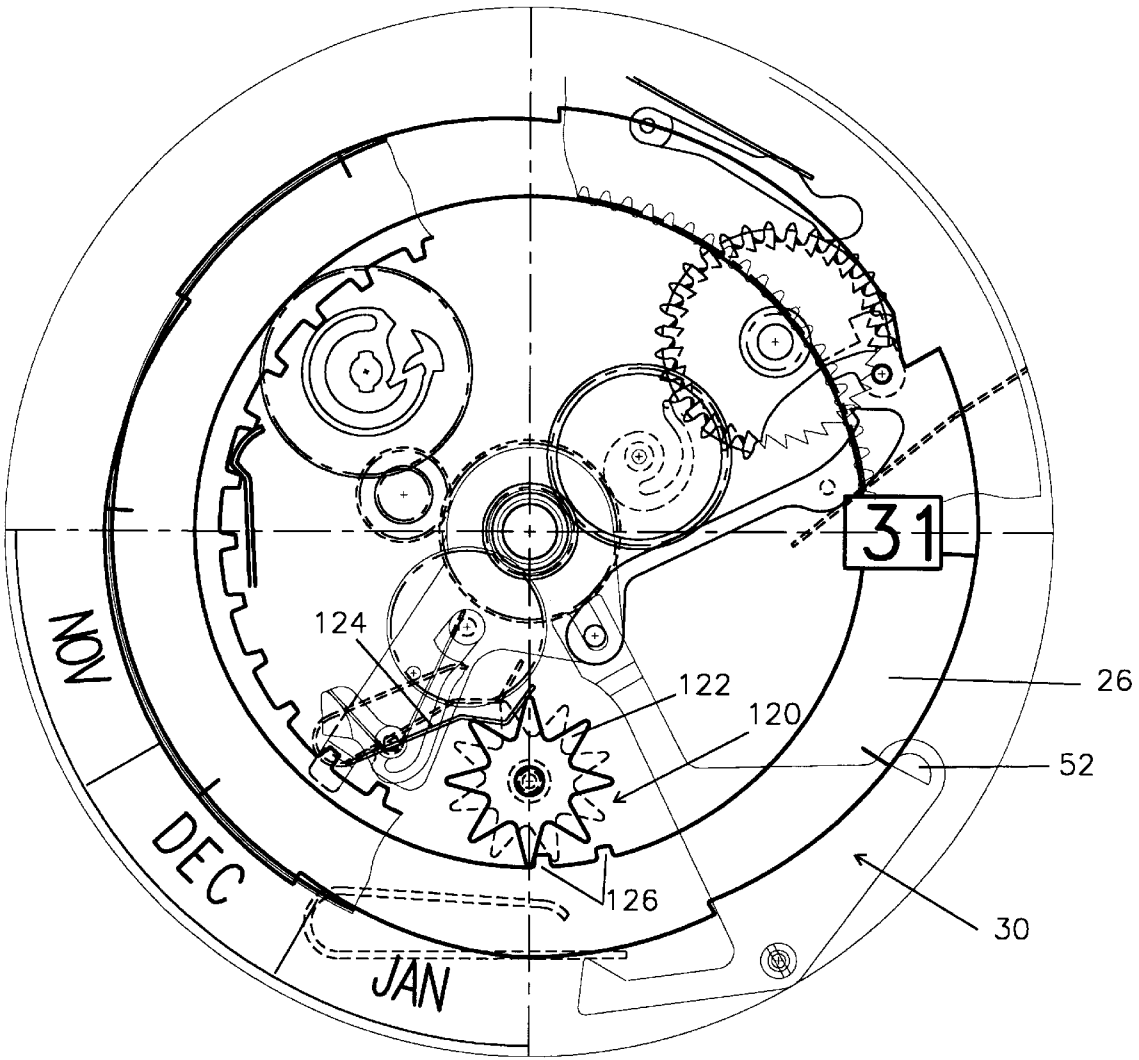
FIG. 12 is also a top view of the movement according to the invention, shown equipped with a device to display leap years

FIG. 10 and 11 show the condition of the movement before and after the three adjusting steps, for the change from the 29th to the 1st, at the end of a month of 28 days.

The movement operates in a manner that is identical to what was described above, except that the number of steps is determined by the depth of the notch E3. This notch has a depth predetermined so that the displacement of the sensor 30 into this notch causes a displacement of ring 2 by three steps, thanks to an angular displacement corresponding, to the mobile assembly.

However, at the end of the month of February in leap years (see FIGS. 14 and 15), the notch E3 may be partially obstructed so as to lead to only a two step displacement of the ring 2, one day later. The obstruction of this notch E3 is done at the right time by means of the mechanism 100 described above and in particular by the flap 102.

Referring now to FIGS. 16 to 24, the correction mechanism according to the invention is described.

This mechanism, like the movement 1, is controlled by a conventional stem 150, which can occupy several axial positions shown in the figures by P0, P1 and P2.

In the first position P0 (neutral), the stem 150 is used to wind up the spring barrel of the movement (not shown) if it is not equipped with an automatic winding system.

Figure 16:
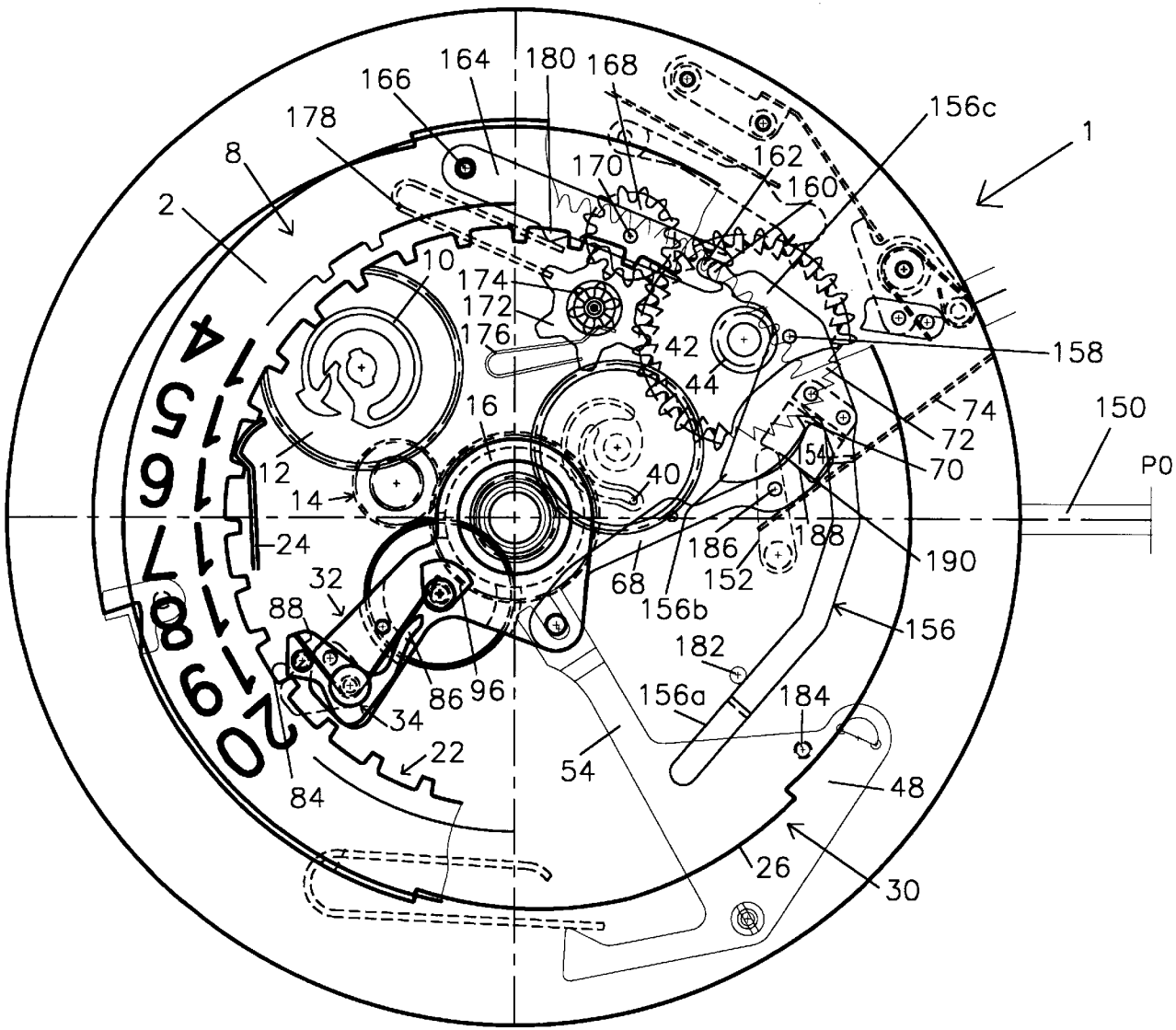

The condition of the correction mechanism according to the invention in the P0 position of the stem 150 is shown in FIG. 16. The different elements forming this mechanism are now described in association with this figure.

This correction mechanism consists of a setting lever 152 pivoted on the movement and operating together with the stem 150 in the conventional manner. One end of this setting lever 152 rests on a plate 154 held, for example by rivets, to a disengaging device 156 consisting of three arms 156*a*, 156*b* and 156*c*.

The disengaging device 156 is mounted pivoting around an axis 158 attached, for example, to a bridge, not represented in the drawing. One end or head 160 of the arm 156*c* enters into a notch 162 of a clutch rocker 164. This is mounted pivoting, by its opposite end, around an axis 166 also mounted, for example, in a bridge, not shown.

The rocker 164 has a wheel 168 that is mounted for free rotation on a central post 170 engaged with the rocker 164. The wheel 168 is continuously engaged to the wheel 42 of the perpetual date device and in this position turns freely.

The mechanism also consists of a control star 172 with six branches that is pivoted on a bottom plate within the circle defined by the date ring 2, so that the teeth of this star 172 may operate together with the toothing 22 of the ring.

The star 172 is integrated with a control pinion 174 with the same number of teeth as the star, which carries it and constitutes with it a mobile control element. This mobile control element is associated with a jumper spring 176, which allows positioning it so that one of the branches of the star 172 is always positioned between two teeth of the toothing 22.

Furthermore, the mechanism includes a return sprint 178 that comes into contact with a protuberance 180 provided on the rocker 164, this spring 178 being attached to the bottom plate of the movement. In this example, the spring 178 has the shape of a thread spring configured as a U.

In the P0 position of the setting lever 150, the spring 178, by its return force, returns the rocker 164 to its initial position at rest and moves it away from the mobile control element, so that the engaging wheel 168 is disengaged from the control pinion 174.

By the linked connection of the rocker 164 with the disengagement device 156, the return force of the spring 178 causes the rotation of that device in the clockwise direction, so that its arm 156*a* rests against a pin 182.

The sensor 30, and in particular its arm 48, includes a pin 184 which projects outside of the plane of the arm 48. The pin 184 is intended to engage with the arm 156*a* of the disengagement device 156 in position P1 of the stem as will be described below in connection with FIG. 17.

Thus, the arm 156*a* may flip between a first position (FIG. 16) in which it rests against the pin 182 when the stem is in P0 position, and a second position (FIG. 17) in which it pushes the pin 184 to disengage the pallet pin 52 from the profile of the cam 26 when the stem 150 is in position P1.

Furthermore, the articulated lever 68 includes, next to its tip, a pin 186 that also projects beyond the plane of the lever. In the P0 position of the stem, the disengagement device 156 does not interact with the pin 184, so that the end of the lever 68 stays engaged with the sawtooth wheel 72. In the P1 position of the stem, the disengagement device 156, which was tipped il the counterclockwise direction, pushes the pin 186 to disengage the tip of the level 68 of the toothing of the wheel 72.

Figure 17:
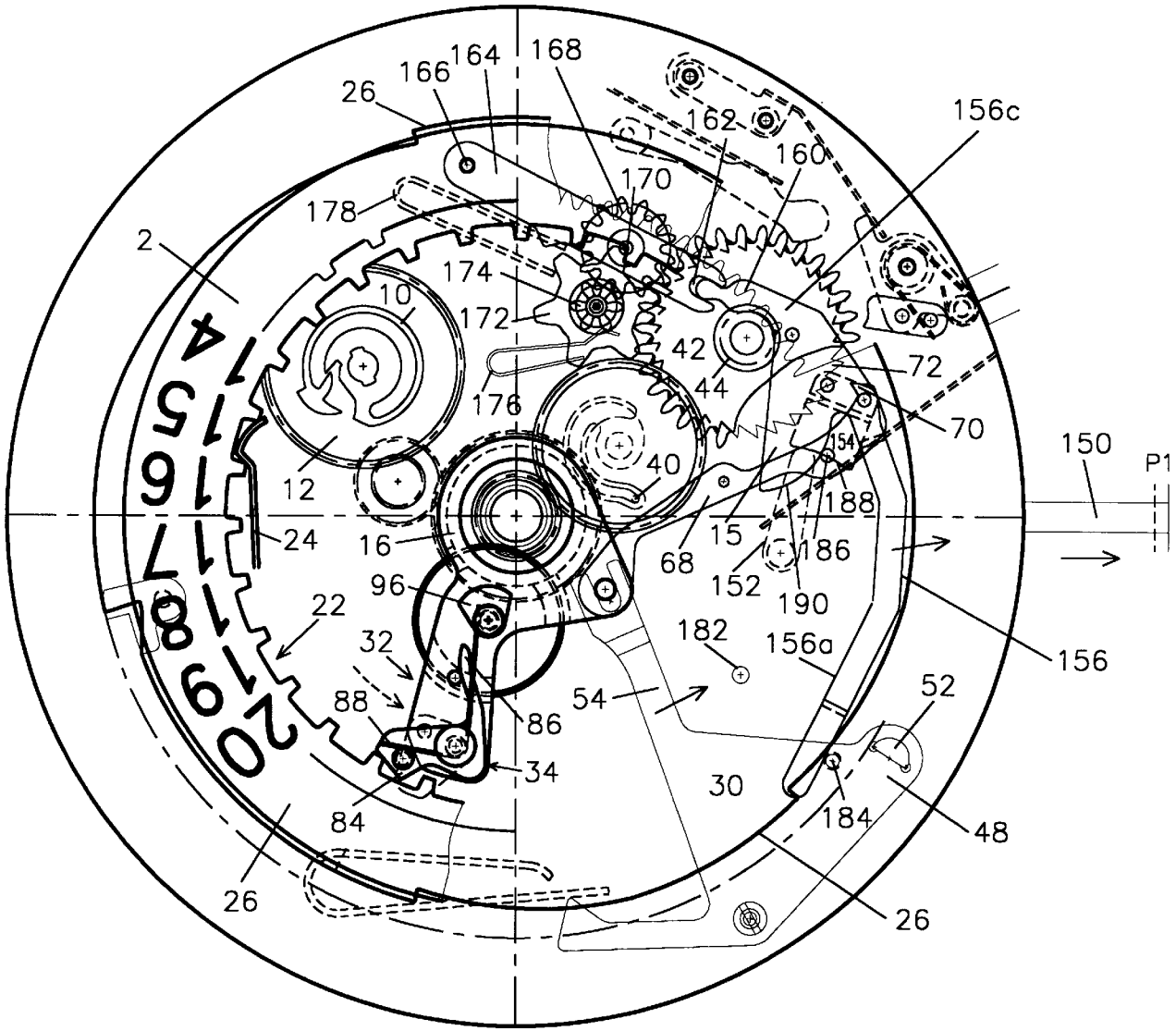

FIG. 17 shows the stem 150 in the position P1, which corresponds to the position that is generally used for setting the date of the day.

In this position, the setting lever 152 was tipped by the movement of the stem in the clockwise direction. The end of the setting level 152, resting against a side 188, concave in shape, of the plate 154, this movement causes tipping, in the counterclockwise direction, of the plate 154 and the disengagement device 156 which is integrated with the plate.

In its movement, the arm 156*a* of the disengagement device leaves the pin 182 to come and push the pin 184, which is integrated with the sensor 30, to disengage the pallet pin 52 sufficiently from the profile of the cam 26 to allow its rotation in both directions, without interfering, with this pallet pin 52.

In its tipping movement, the sensor 30 drives, with its arm 54, the tipping of the mobile assembly 32 in the counterclockwise direction, this tipping causing the movement of the pawl 34 above the teeth of the toothing 22 of the ring 2, without driving the ring 2, since the return force of the spring 88 is weaker than that of the jumper spring 24.

Thus the mobile assembly 32 will take a non-functional intermediate, but nevertheless well established.

In this position of the tipping of the mobile assembly 32, the pawl 34 must be located so that the inertial cam 96, during its rotation over 24 hours, always passes beside the end of the elastic arm 86, the tip 84 of the pawl 34 being engaged in the toothing 22 of the ring 2, as if the normal adjusting operation were to take place. This arrangement allows forward and backward time setting at whatever time the movement is stopped, since the inertial cam 96 always passes behind the end of the arm 86 without displacing it and consequently, without displacing the pawl 34.

The tipping of the disengagement device 156 in the counterclockwise direction also allows the disengagement of the lever 68, and more particularly of the tip 70 of the toothing of the sawtooth wheel 72, in order to allow rotation of the wheel 72 in both directions, which is connected to the correction mechanism according to the invention, in position P1 of the stem.

In order to do this, the arm 156*a* of the disengagement device 156 presents a rounded side 190, which pushes the pin 186, integrated with the lever 68, The kinematics of this arrangement are specified so that the tip 70 is located in this tipping position outside of the field of the toothing of the wheel 72.

The tipping of the disengagement device 156 also causes the tipping of the rocker 164 in the clockwise direction by the action of the end 160 of the arm 156*c* engaged in the notch 162. This displacement of the rocker allows the meshing of the engagement wheel 168 with the control pinion 174 which is integrated with the control star 172 in contact with the toothing 22 of the ring 2.

FIG. 18 shows the synchronization of the functions of correction, particularly of the rapid date setting, by means of the stem 150 which is located in the P1 position.

In this position, the advance of the date ring is done by means of a wheel 192 integrated in the conventional manner in rotation with the stem 150. This wheel 192 meshes with a sliding pinion 194 integrated with a rapid correction wheel 196, for example with three pins. The number of pins determines the correction speed of the ring 2 and may be fewer or more than three.

This rapid correction wheel 196 is intended to drive the date ring 2 in the clockwise direction, while the stem 150, in its P1 position is turned in a negative rotation direction symbolized by the arrow SN (FIG. 18).

During its rotation, the ring 2 drives the control star 172 with six branches in the example shown. At each movement from one tooth of the toothing 22 there corresponds a movement of one branch of the control star 172.

The control pinion 174, integrated with the control star 172, thus also makes one sixth of a turn for a step of the date ring. It will be noted that, in this example, a step of the date ring 2 corresponds to one day.

Given that in P1 position of the stem 150, the control pinion meshes with the wheel 168 integrated with the rocker 164, the advance of one sixth of a turn of the control pinion 174 drives the advance of a step of the wheel 168.

The wheel 168 being engaged with the wheel 42, integrated with the sawtooth wheel 72, the advance of its tooth corresponds to the normal daily advance that the wheels 42 and 72 would have made driven by the finger 40, which allows the driving of the cam 26 by 1/372nd of a turn by the pinion 44, as described above.

Thanks to this arrangement, at the time of the operation of rapid correction, a synchronization function of the movement of the date rinse 2 is carried out with the movement of the cam 26.

In this function, the date ring 2 controls the advance of the cam 26, this ring being the leader.

At the time of the rapid correction by means of a corrector such as the one just described, it is common that the operator unintentionally passes by the day that he wanted to display in the window and displaces the date ring by one or more days beyond the desired position. With a conventional date device, this error in manipulation is not very bothersome, because the operator only has to give the date ring an additional turn to find the desired date position.

However, in the case of a perpetual date clock, this error in manipulation is much more harmful. After such all error, the operator must turn the stem to pass all the months of the four following years in order to find the desired date position.

According to the invention, there will be described below particularly in connection with FIG. 19, a device allowing the elimination of this disadvantage.

As will be understood, this device easily allows, at the time of such an error in manipulation, going back one or more steps to display the desired date without disturbing the synchronization of the different elements of the perpetual mechanism.

This device consists of a correction module 200 with a pawl equipped with a plate 202 that is mounted pivoting on the bottom plate, not shown, around an axis 204. This plate 202 carries a pawl 206 mounted pivoting around an axis 208 projecting from the plate 202.

The plate 202 comprises, in addition, a pin 210 on which there rests a spring 212 integrated with the bottom plate to return the plate to its initial position at rest shown in FIG. 18, position in which the correction module comes into contact with the head of a pusher 214 partially shown in the drawing.

The pawl 206 comprises, at one ends a tip 216 and at a second opposite end, a post 218 pressed fit within this pawl.

The plate 202 also carries a cylindrical stop 220 on which the pusher 214 rests.

The correction module 200 comprises, in addition, a pawl spring 222 that winds, on the one hand, around the stop 220 being attached to it and, on the other hand, around the axis 204 to rest by its free end against the post 218 which rests against an edge of the plate 202.

FIG. 19 shows the operation of the correction module 200, By applying pressure on the pusher 214, for example with the aid of a pointed tool, such as the point of a ball point pen, the stop 220 is acted upon, causing the rocking of the plate 202 in the clockwise direction and leads the tip 216 to push a tooth of the wheel 42 in the counterclockwise direction.

The rotation of this wheel 42 in the counterclockwise direction causes the displacement by one step of the date rind in the inverse direction by means of the wheel 168, of the control pinion 174 and the control star 172 which are connected kinematically in the P1 position of the control stem 150.

The date displayed may therefore be corrected backwards while retaining the synchronization of the perpetual mechanism with the ring 2, as FIG. 21 shows, since the wheel 42, integrated with the pinion 44 correspondingly also drives the cam 26 in the inverse direction by 1/372nd of a turn.

By relaxing the pressure on the pusher 214, the return spring 212 returns the module 200 to its initial position. During this movement, the tip 216, thanks to the pivoting of the pawl, passes above a tooth of the wheel 42 which is kept immobile in position by the jumper 78.

In FIG. 20, the correction mechanism is mounted with the stem 150 drawn into its P2 position. This additional traction of the stem does not influence the position of the elements of the mechanism that were just described.

The end of the setting lever 152 has continued its rotation in the clockwise direction, with only the effect of displacing itself along the length of the concave side 188 of the plate 154, without causing its additional displacement or that of the disengagement device 156. This results from the fact that, in this position, the concave side 188 is centered on the axis of rotation of the setting lever 152.

The complete traction of the stem 150 has the effect of disconnecting the wheel 192 from the rapid correction wheel 194 which takes a non-functional position.

According to the example shown in the P2 position of the stem, the rotation of this stem 1550 in the negative direction SN allows the rotation of the hour and minute hands in the clockwise direction. In this position, all the functions of the basic movement, of its date and of its perpetual calendar with the rapid date setting, are retained.

The 24-hour wheel 12 carrying, the elastic arm 10 turns in the clockwise direction in this case by the manual control of the cannon wheel 16 to drive the ring 2 in the clockwise direction. Similarly, the cannon wheel 16 also controls the displacement of the finger 40 in the counterclockwise direction so that it drives the wheel 42 in the counterclockwise direction to maintain the synchronization of the perpetual date after the normal change of the date.

The wheel 42 drives the displacement of one step of the wheel 168 which, in the P2 position of the stem, is engaged with the control pinion 174. This displacement drives the rotation in the counterclockwise direction of the date ring by one of the branches of the control star 179.

During the normal change of date or of adjustment, the pawl 34 remains free to pivot at the time of the displacement of the date ring 2.

FIG. 20 shows the correction mechanism according to the invention in the period between midnight and 4:00 a.m., the stem 150 being in the P2 position and being rotated in the negative direction. It can be noted that if the time setting is done during this period, the stop position of the pawl is such that the end of its arm 86 is driven by the inertial cam 96 during the rotation, so that the tip 84 of the pawl 34 moves away from the field of the toothing 22 of ring 2.

In these conditions, if this position should remain after the rotation of the stem 150 in the negative direction, in the period from midnight to 4:00 a.m., the ring 2 would remain immobile when the mobile assembly 32 moves back.

FIG. 22 shows the operation of the time setting, by the rotation of the stem in the positive direction SP. In this case, it is noted that the end on the finger 40 turns in the clockwise direction and that the elastic assembly of this finger 40 allows its displacement in rotation without driving the 31-tooth wheel 42 which is kept in position by the jumper 76.

As specified above, for the rotation of the stem in the negative direction, it is not advisable to set the time between midnight and 4:00 a.m. The inertial cam 96 that turns in the counterclockwise direction will come into contact with the end of the arm 86 of the pawl 34 and block its operation by ending up against the pin 98.

FIG. 23 shows a day display device 250, consisting of a star with seven branches 252 carrying a day display ring not shown in the drawing and mounted in rotation on the bottom plate. In the normal operating, mode of movement 1, this star 252 is driven once a day by a 24-hour wheel, designated 254, provided with an elastic arm 256 having a configuration that is analogous to the driving wheel 12 of the date ring (FIG. 20). The wheel 254 is continuously engaged with the pinion 36 carried by the hour cannon wheel.

Thus, when the cannon wheel 16 rotates in the clockwise direction, the pinion 36 drives the wheel 254 in the counterclockwise direction, which in turn drives the star 252 in the clockwise direction, by a hook 258 situated at the end of the arm 256. This star is held in position by a jumper spring 260.

Referring also to FIG. 24, a description will now be given of how the day display device 250 can be put into phase with the current time.

In order to do this, the correction mechanism also includes a rocking lever 270 linked to a pivot 272 integrated with the bottom plate.

This lever 270 comprises a swan's-neck first arm 274 whose free end is intended to interact with the star 252 to make it advance by steps. The lever 270 has a second arm 276 whose free end is intended to interact with a two-fingered wheel 278, integrated with the wheel 192.

The lever 270 is returned to a position of rest, disengaged from the toothing of the star 252, by means of a return spring, for example a leaf spring, designated 280, fixed in the bottom plate by a post 282 and by a screw 284.

When the stem is withdrawn into the P1 position, as shown in FIG. 24, and the stem 1550 is put in rotation in the positive direction, wheels 192 and 278 are driven in rotation in the clockwise direction, displacing, the rocking, bar 196 into an inactive position, shown in the figure, in which it is outside of the field of the toothing 22 of the ring 2.

Thus, at each half turn of the wheel 278 in the clockwise direction, one of the fingers rocks the lever 270 and the free end of the arm 274 makes the star 252 advance by one step, each step representing a day of the week.

In FIG. 23, it will be noted that the end 258 of the elastic arm 256 includes on a side opposite the first face which normally drives the star 252, a ramp 288 allowing the arm 256 to retract, at the time of setting the hands in the negative direction, without involving the star 252, the flexibility of the arm 258 being greater than the moment of maintenance of the jumper 260.

What is claimed is:

1. Time setting mechanism of a perpetual date clock movement (1) which includes a drive device (8) tor driving a date indicator (2) comprising driving means (10) that can advance said indicator (2) by a jump once every 24 hours this movement (1) further comprising an adjustment device allowing this indicator (2) to make adjusting steps to take account automatically of months with 28, 29 or 30 days, said device including a rotating cam (26) driven by at least one step every 24 hours, this cam having a profile (28) suitable for driving a sensor (3) causing:

on the one hand, the oscillating movement of a mobile assembly (32) provided with a pawl system (34) to make the date indicator (2) advance by the additional step or steps required, and on the other hand, the advance of this cam (26) in order to have it make a number of steps equal to the number of adjusting steps of this indicator (2), in order to make it carry out one complete turn per year, characterized in that it comprises means (156) for disengaging the sensor (30) to disengage it from the profile (28) of that cam (26), and means for coupling the indicator with said cam, said coupling means (164) being driven by said disengagement means (156) which are controlled by a control stem (150).

2. Mechanism according to claim 1, characterized in that said disengagement means (156) are driven by a setting lever (152) associated with the stem (150).

3. A mechanism according to one of the claims 1 and 2, characterized in that the coupling means (164) consists, on the one hand, of a correction star (172) continuously engaged with the indicator (2) and on the other hand of a wheel (168) connected to a rocker (164) which is controlled by said disengagement means (156), this wheel (168) being continuously engaged with a mobile element (42, 72) controlling the rotation of the cam (26).

4. Mechanism according to claim 1, wherein the disengagement means (156) comprises a device mounted pivoting on the movement and consisting of three arms (156*a*, 156*b*, 156*c*).

5. Mechanism according to claim 4, characterized in that, in a pulled position (P1, P2) of the stem, the first arm (156*a*) of the device is set to push the sensor (30), the second arm (156*b*) is set to push an adjusting lever (68) to disengage from the toothing (of a wheel of a mobile element (42, 72) controlling, the rotation of the cam (26), and the third arm (156*c*) is set to control the coupling system (164).

6. Mechanism according to claim 5, characterized in that the coupling means (164) consists of a clutch rocker pivoted on the movement by one of its ends, and in that the third arm (156*c*) includes a head (160) which enters into a notch (162) provided for at the other end of this rocker.

7. Mechanism according to claim 1, further comprising a pawl-actuated corrected module (200) provided with a pivoting plate (202) carrying a pawl (206) mounted pivoting around an axis (208) connected to this plat, this pawl including a tip (216) capable of pushing a tooth of a wheel of a mobile element (42, 72) controlling, on the one hand, the rotation of the cam (26) in the counterclockwise direction and on the other hand, the rotation of the date ring (2) in the counterclockwise direction, by the coupling means (164), in a withdrawn position (P1) of the stem (150), in response to a pressure exercised by a pusher (214) on this pawl (206).

8. Mechanism according to claim 1, further comprising a rocking lever (270) including a first arm (274) set to make a day star (252) advance by steps and a second arm (276) interacting with a wheel (278) with two fingers engaged with a rocking bar pinion (196) in a withdrawn position (P1) of the stem (150).

* * * * *